US009775433B2

(12) United States Patent
Shinozaki

(10) Patent No.: US 9,775,433 B2
(45) Date of Patent: Oct. 3, 2017

(54) COUPLING MEMBER AND READY-TO-ASSEMBLE SHELVING THAT USES SAME

(71) Applicant: KAWAJUN CO., LTD., Tokyo (JP)

(72) Inventor: Takashi Shinozaki, Tokyo (JP)

(73) Assignee: KAWAJUN CO., LTD., Tokyo (JP)

( * ) Notice: Subject to any disclaimer, the term of this patent is extended or adjusted under 35 U.S.C. 154(b) by 29 days.

(21) Appl. No.: 14/772,475

(22) PCT Filed: Feb. 7, 2014

(86) PCT No.: PCT/JP2014/052903
§ 371 (c)(1),
(2) Date: Sep. 3, 2015

(87) PCT Pub. No.: WO2014/136526
PCT Pub. Date: Sep. 12, 2014

(65) Prior Publication Data
US 2016/0007739 A1 Jan. 14, 2016

(30) Foreign Application Priority Data
Mar. 5, 2013 (JP) ..... 2013-042892

(51) Int. Cl.
*A47B 57/20* (2006.01)
*A47B 57/48* (2006.01)
(Continued)

(52) U.S. Cl.
CPC ..... *A47B 57/34* (2013.01); *A47B 47/0083* (2013.01); *A47B 57/545* (2013.01); *A47B 96/024* (2013.01)

(58) Field of Classification Search
CPC ..... A47B 47/0083; A47B 57/30; A47B 57/32; A47B 57/34; A47B 57/545; A47B 57/56;
(Continued)

(56) References Cited

U.S. PATENT DOCUMENTS 3,343,685 A * 9/1967 Giambalvo ..... A47B 47/042 108/108
3,606,028 A * 9/1971 Klein ..... A47B 57/30 211/191
(Continued)

FOREIGN PATENT DOCUMENTS

CN 102014697 A 4/2011
EP 2 289 368 A1 3/2011
(Continued)

OTHER PUBLICATIONS

Extended Search Report dated Mar. 9, 2016, issued in counterpart European Application No. 14759922 (6 pages).
(Continued)

*Primary Examiner* — Joshua Rodden
(74) *Attorney, Agent, or Firm* — Westerman, Hattori, Daniels & Adrian, LLP

(57) ABSTRACT

A coupling member (1) includes a pair of support members (11*a*, 11*b*) that are linked at one end so that an opening is formed at the opposite end, and the back sides thereof are situated opposite to each other, and a pair of engagement holes (12*a*, 12*b*) that are respectively formed in the support members (11*a*, 11*b*) in the thickness direction so as to extend from the back sides, and are situated opposite to each other, the outer side (a to d) of each of the support members (11*a*, 11*b*) forming a tapered surface that gradually slopes outward in the downward direction. An assembly shelf utilizes the coupling member (1). The assembly shelf utilizes an L-shaped angle, and is configured so that a shelf board member is not provided with a protrusion, a tool is unnecessary during assembly, and a middle shelf board can be removed conditionally.

11 Claims, 42 Drawing Sheets

(51) Int. Cl.

| | |
|---|---|
| ***A47B 47/00*** | (2006.01) |
| ***A47B 57/34*** | (2006.01) |
| ***A47B 57/54*** | (2006.01) |
| ***A47B 96/02*** | (2006.01) |

(58) Field of Classification Search
CPC . A47B 57/562; A47B 57/567; A47B 87/0223; A47B 96/022; A47B 96/024; A47B 96/027; A47B 96/028; A47B 2087/023; A47B 2087/0238
USPC ..... 211/187, 189, 190, 192; 108/147.13
See application file for complete search history.

(56) References Cited

U.S. PATENT DOCUMENTS

| | | | | |
|---|---|---|---|---|
| 4,230,052 | A | 10/1980 | Champagne | |
| 4,615,278 | A | 10/1986 | Cabrelli | |
| 5,127,342 | A * | 7/1992 | Taylor | A47B 57/265 108/147.13 |
| 5,779,070 | A * | 7/1998 | Dickinson | A47B 57/265 211/181.1 |
| 6,302,284 | B1 * | 10/2001 | Zonshin | A47B 47/0083 108/147.11 |
| 7,478,971 | B2 * | 1/2009 | Li | A47B 57/545 108/147.13 |
| 8,286,564 | B2 * | 10/2012 | Karl | A47B 57/545 108/107 |
| 2002/0046982 | A1 * | 4/2002 | Guizzardi | A47B 57/545 211/187 |
| 2002/0113180 | A1 * | 8/2002 | Wiebe | A47B 57/265 248/188 |
| 2011/0056899 | A1 | 3/2011 | Shinozaki | |

FOREIGN PATENT DOCUMENTS

| | | | |
|---|---|---|---|
| GB | 986722 | A | 3/1965 |
| JP | 10-165233 | A | 6/1998 |
| JP | 10-167075 | A | 6/1998 |
| JP | 3057990 | U | 6/1999 |
| JP | 3104160 | U | 9/2004 |
| JP | 2008-212414 | A | 9/2008 |
| JP | 4518436 | B1 | 8/2010 |

OTHER PUBLICATIONS

International Search Report dated Apr. 1, 2014, issued in counterpart application No. PCT/JP2014/052903 (1 page).
English translation of Office Action dated Dec. 14, 2016, issued in counterpart Chinese Patent Application No. 201480011961.0, (6 pages).
Office Action dated Dec. 14, 2016, issued in counterpart Chinese Patent Application No. 201480011961.0, with Engilsh translation. (7 pages).

* cited by examiner

【Fig. 1】
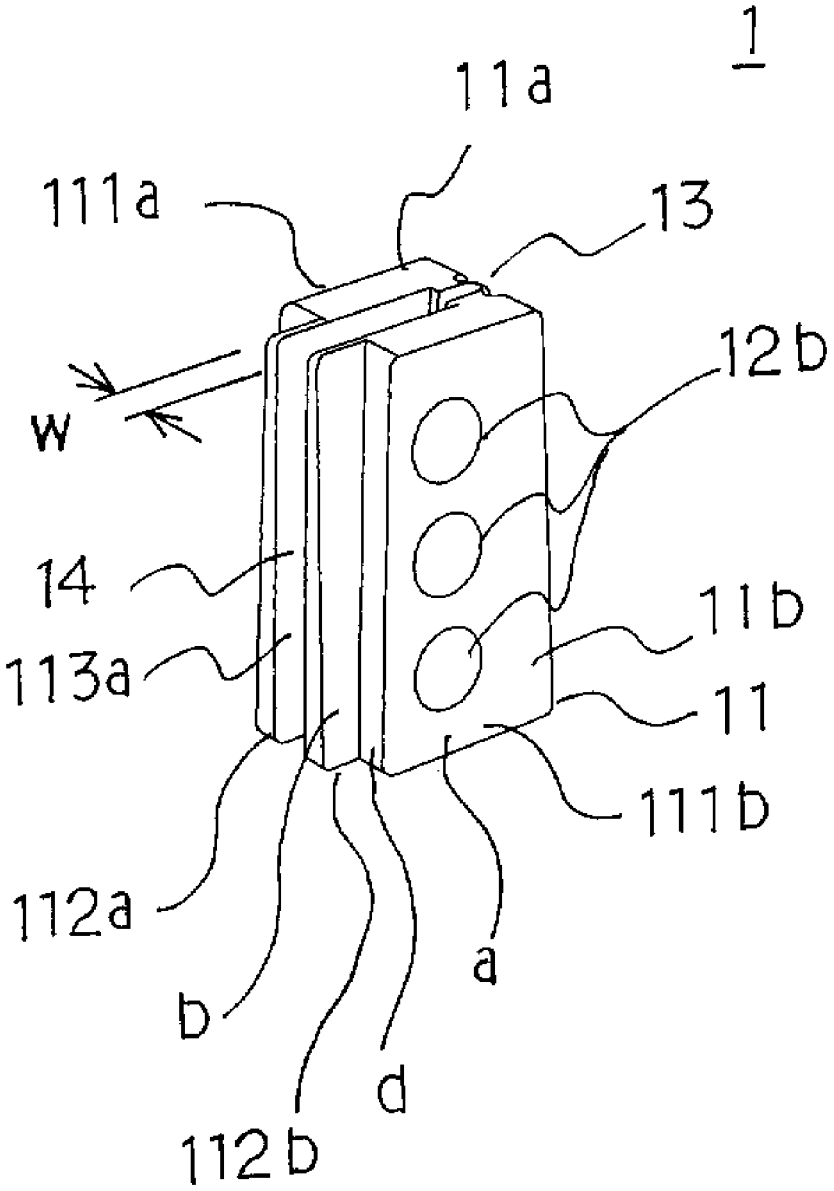

【Fig. 2】
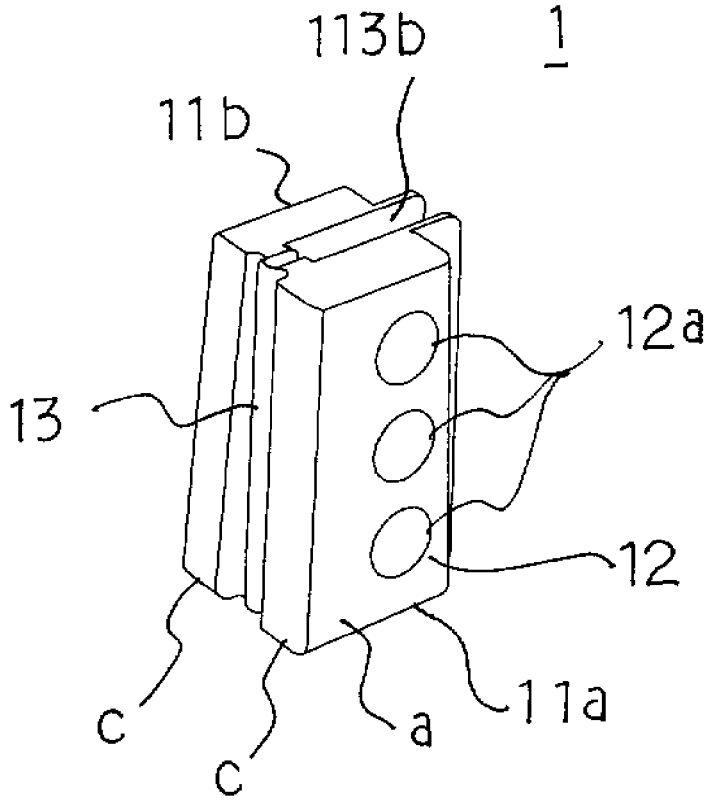

【Fig. 3】
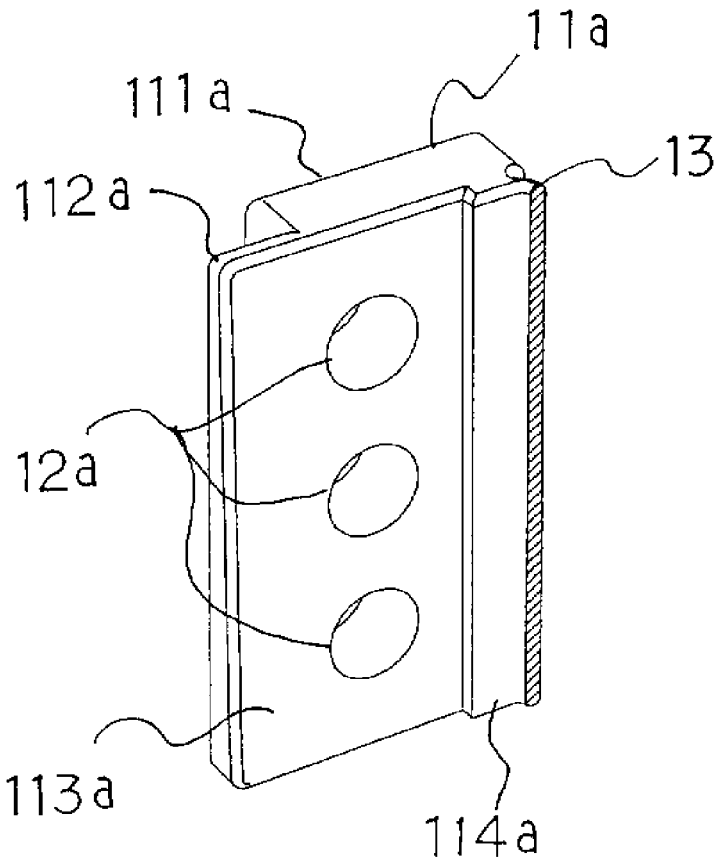

【Fig. 4】
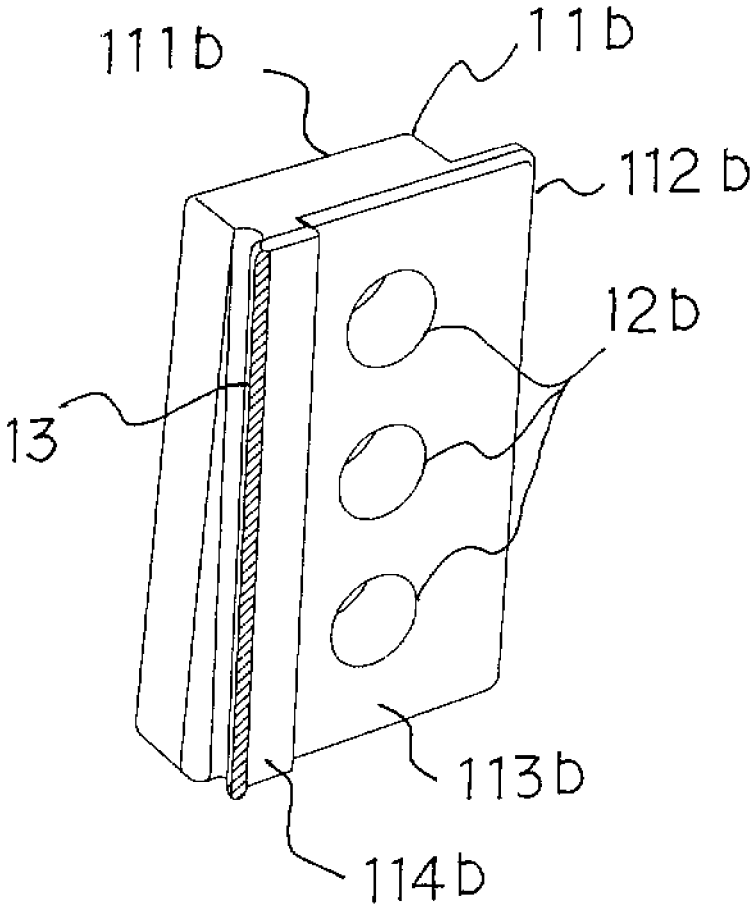

【Fig. 5】
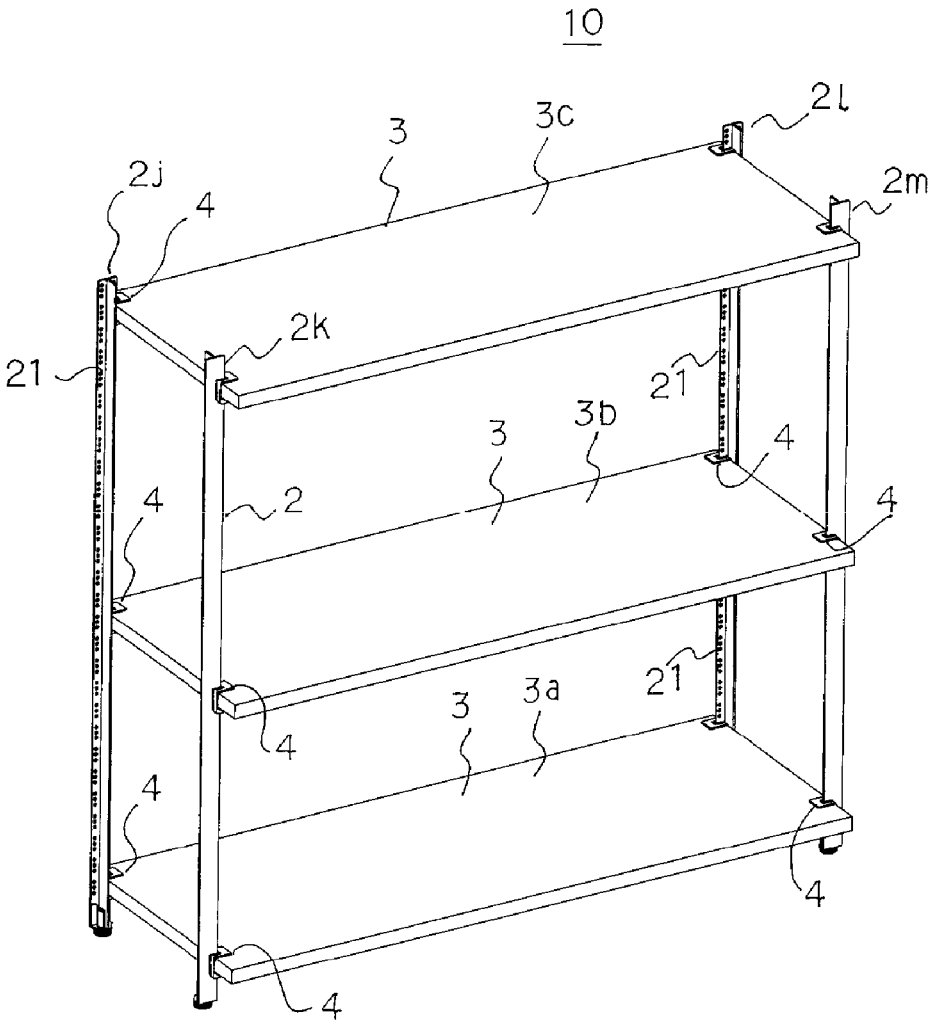

【Fig. 6】
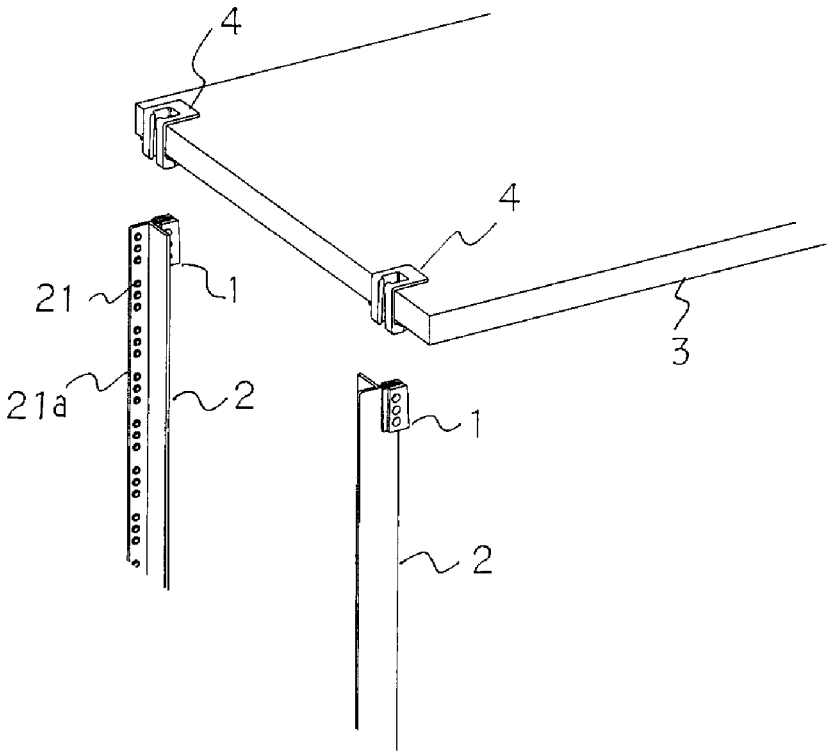

【Fig. 7】
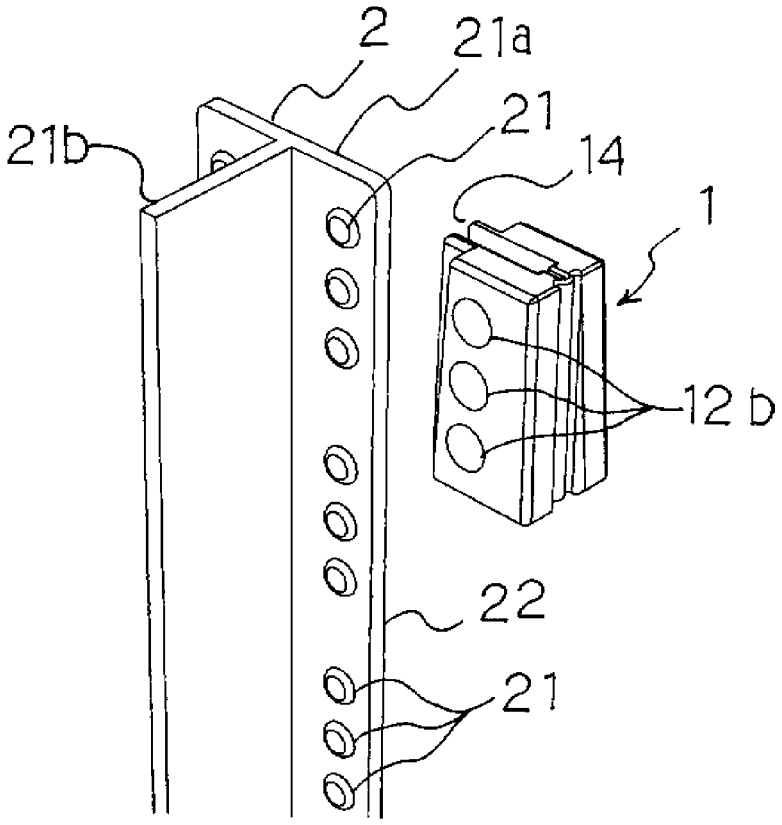

【Fig. 8】
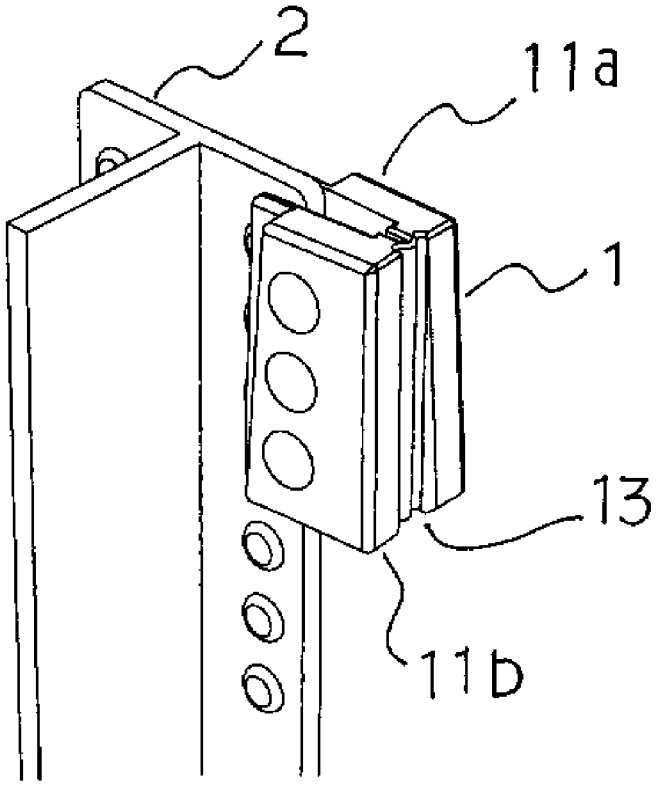

【Fig. 9】
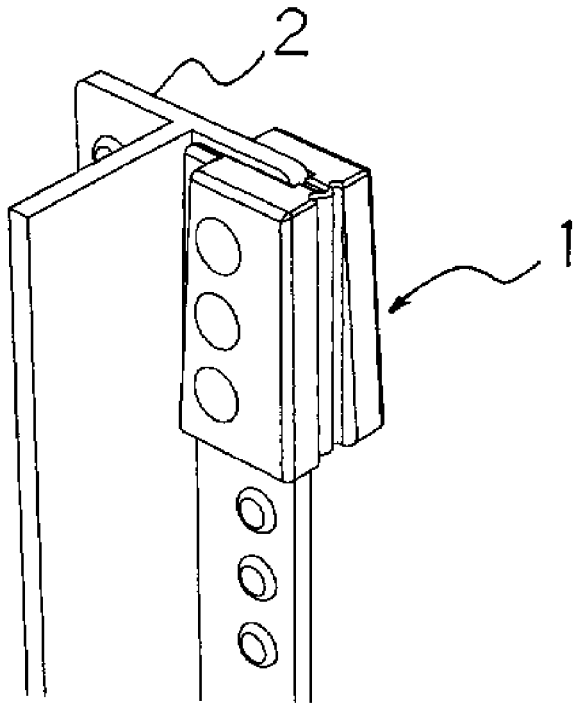

【Fig. 1 0】
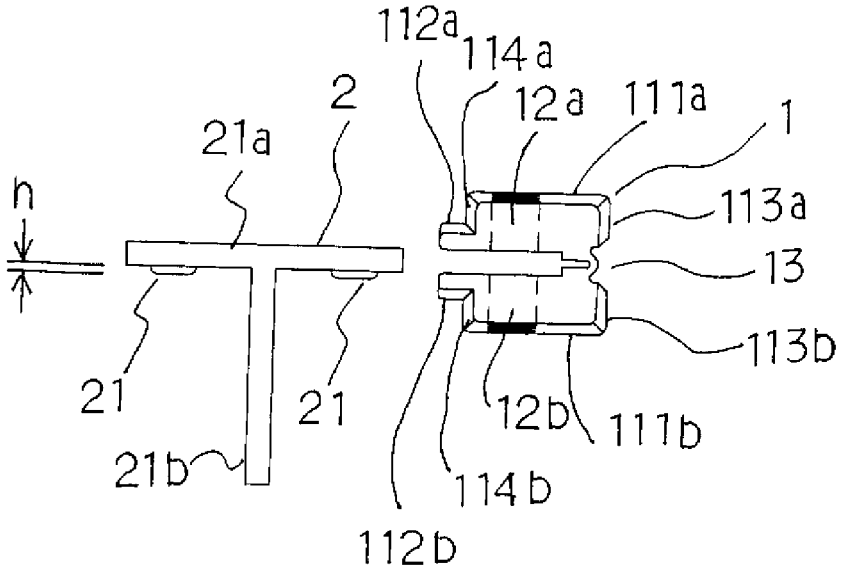

【Fig. 1 1】
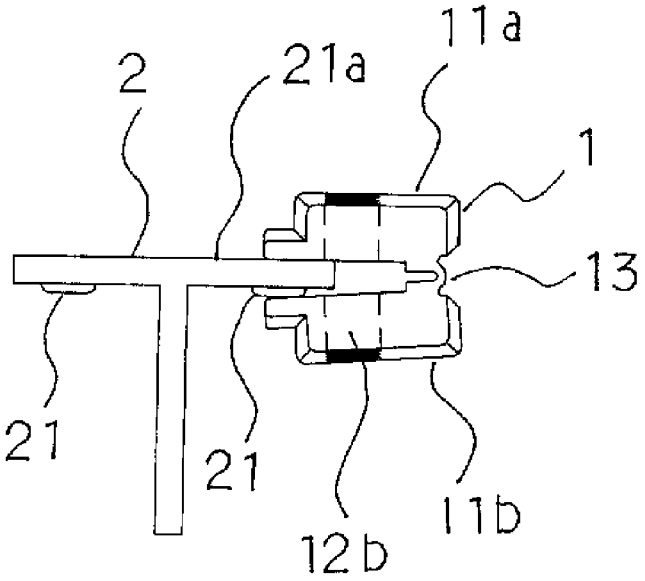

【Fig. 1 2】
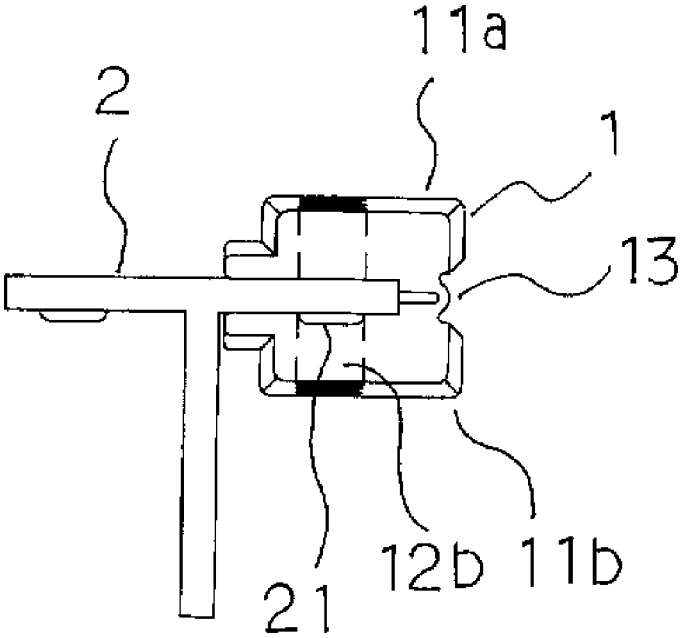

【Fig. 1 3】
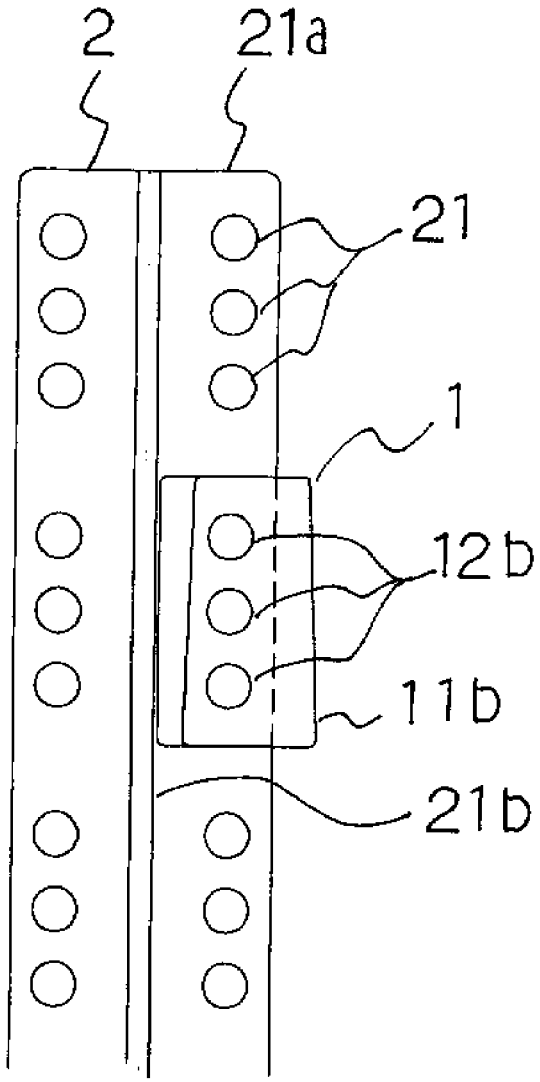

【Fig. 1 4】
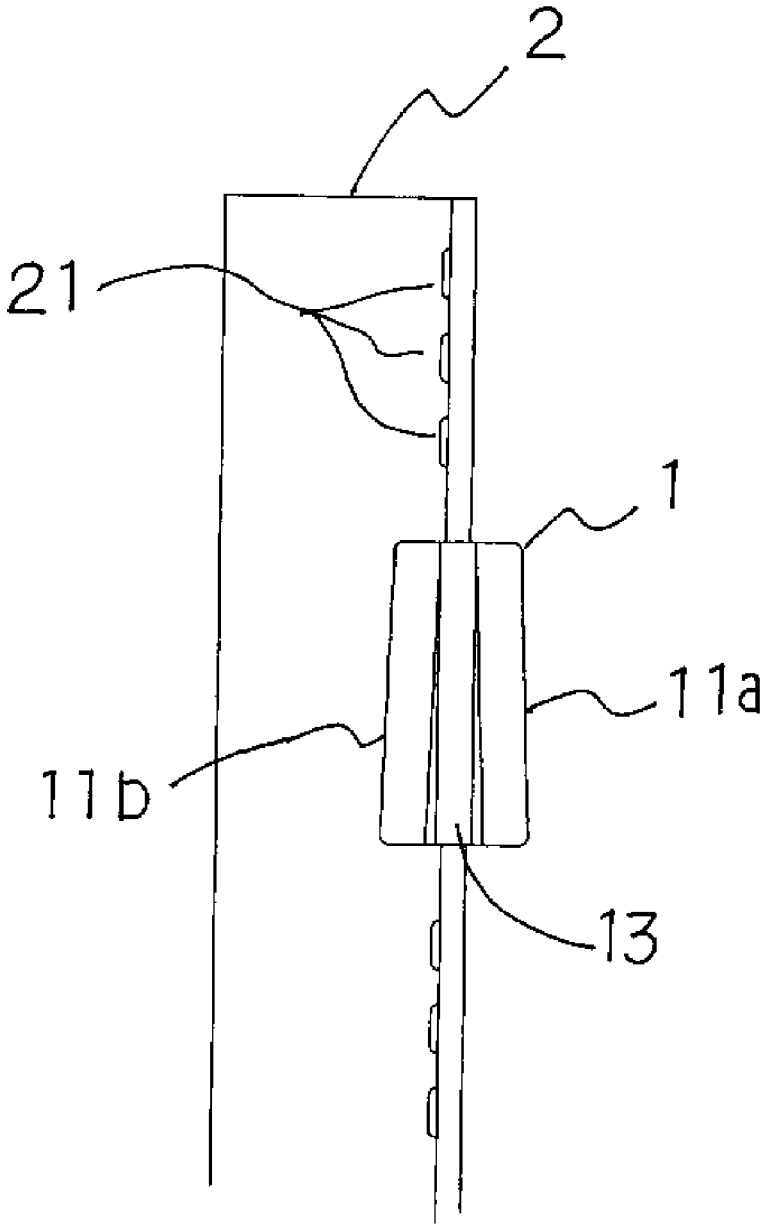

【Fig. 1 5】
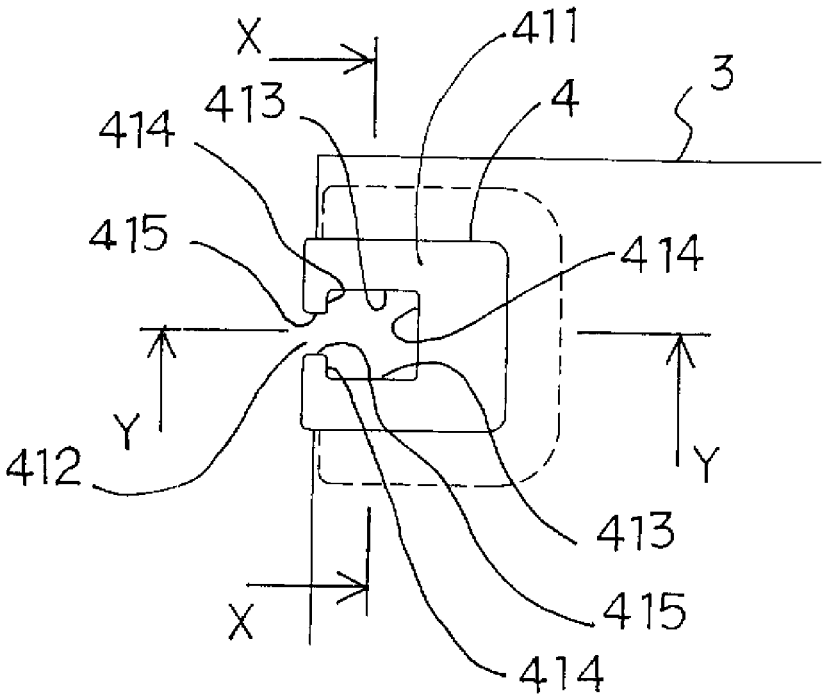

【Fig. 1 6】
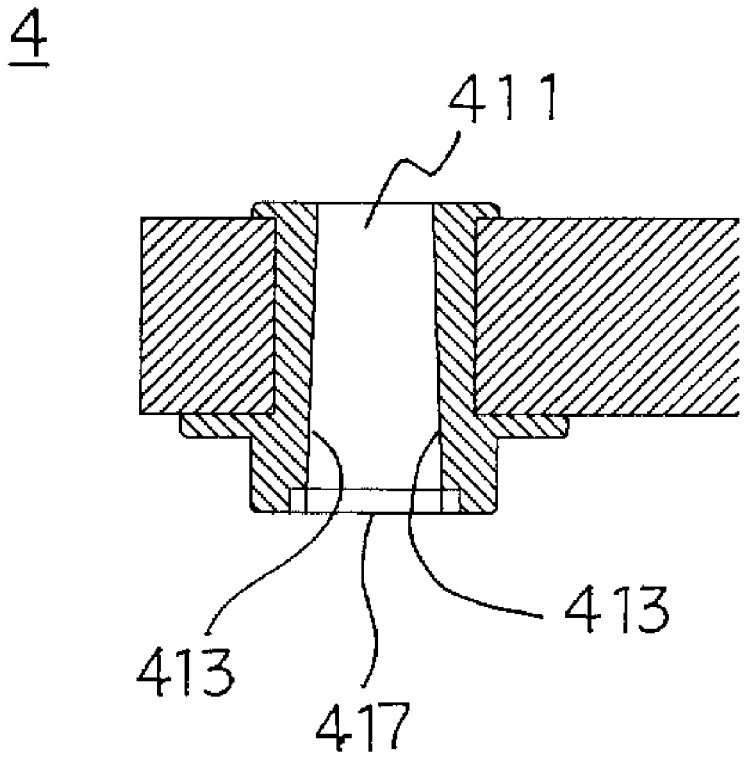

【Fig. 1 7】
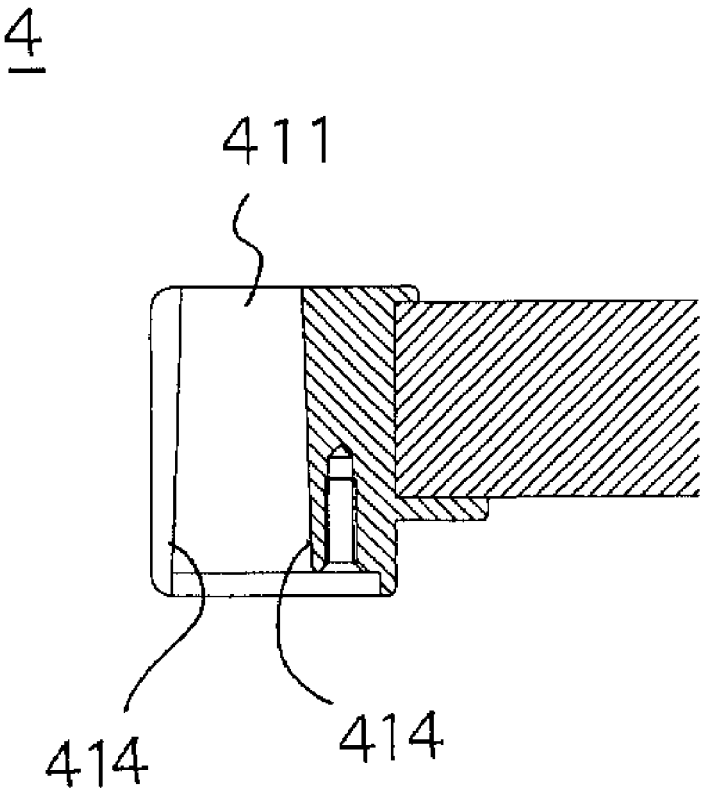

【Fig. 1 8】
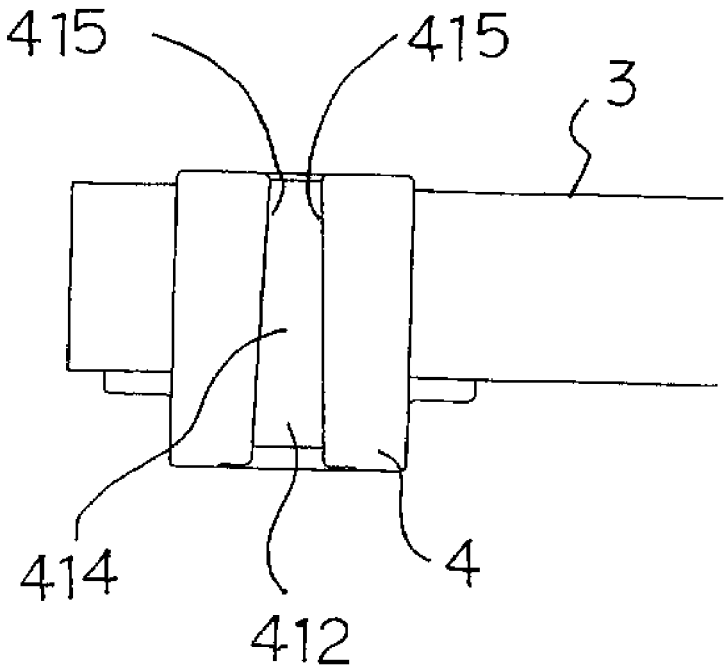

【Fig. 1 9】
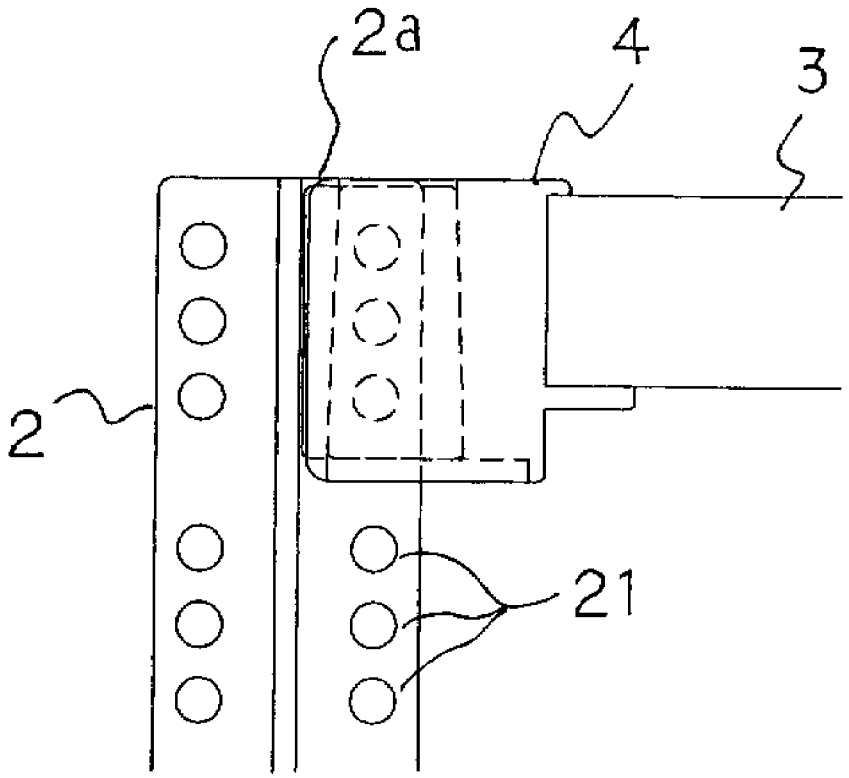

【Fig. 2 0】
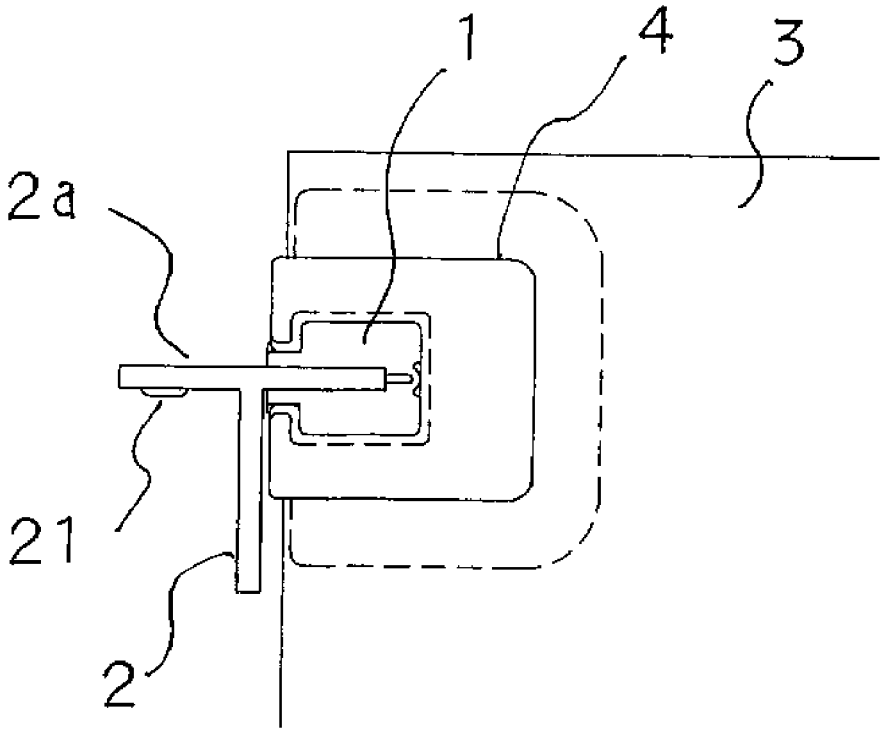

【Fig. 2 1】
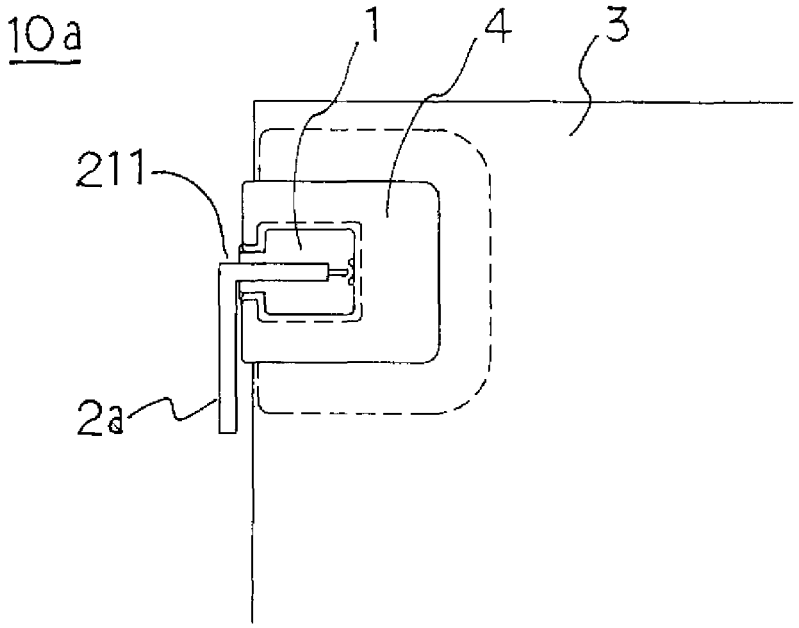

【Fig. 2 2】
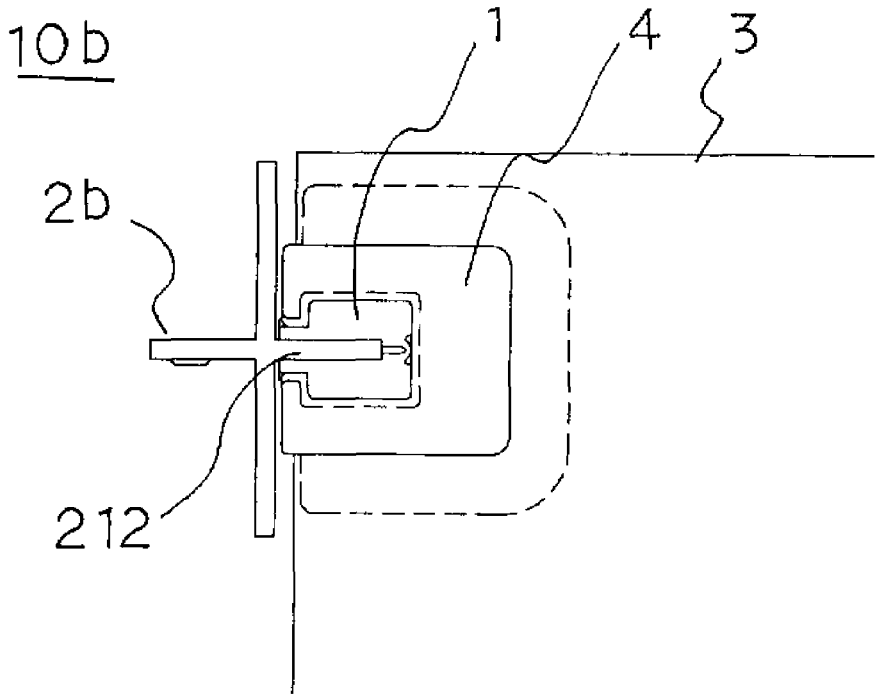

【Fig. 2 3】
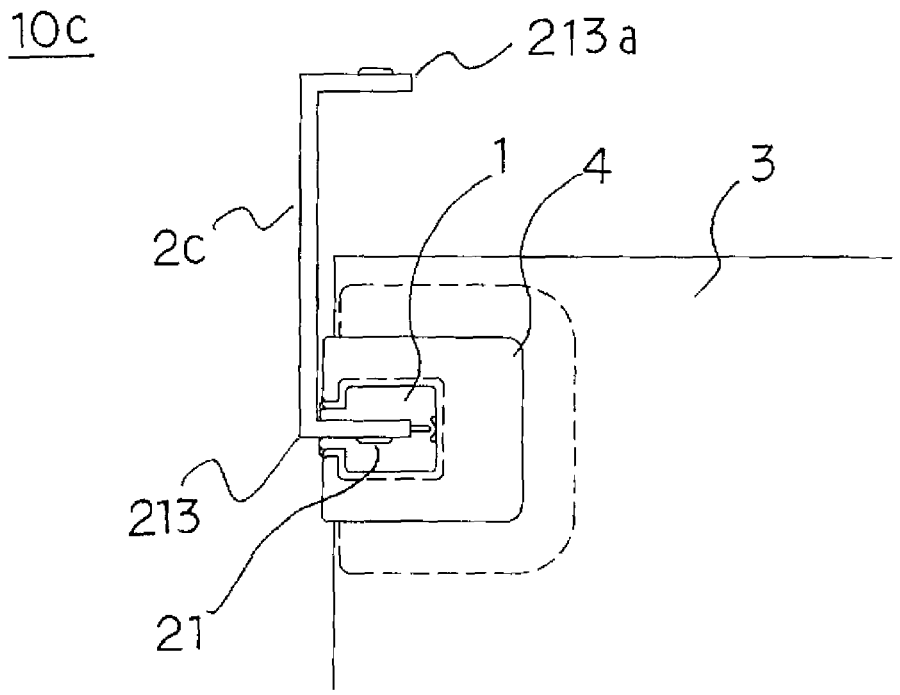

【Fig. 2 4】
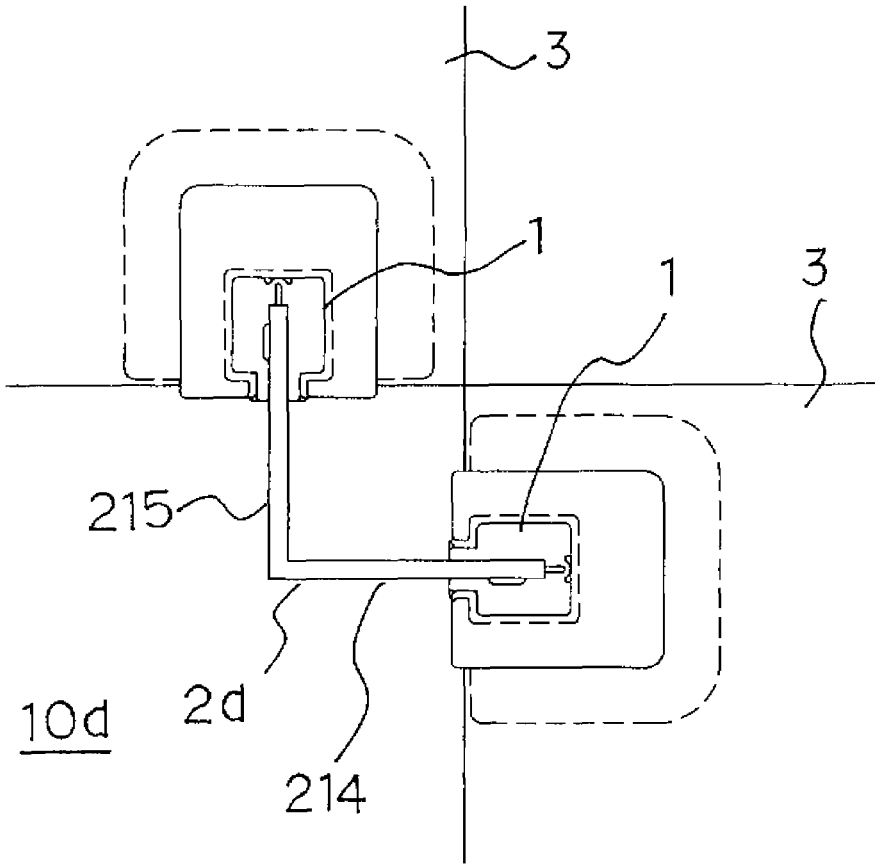

【Fig. 2 5】
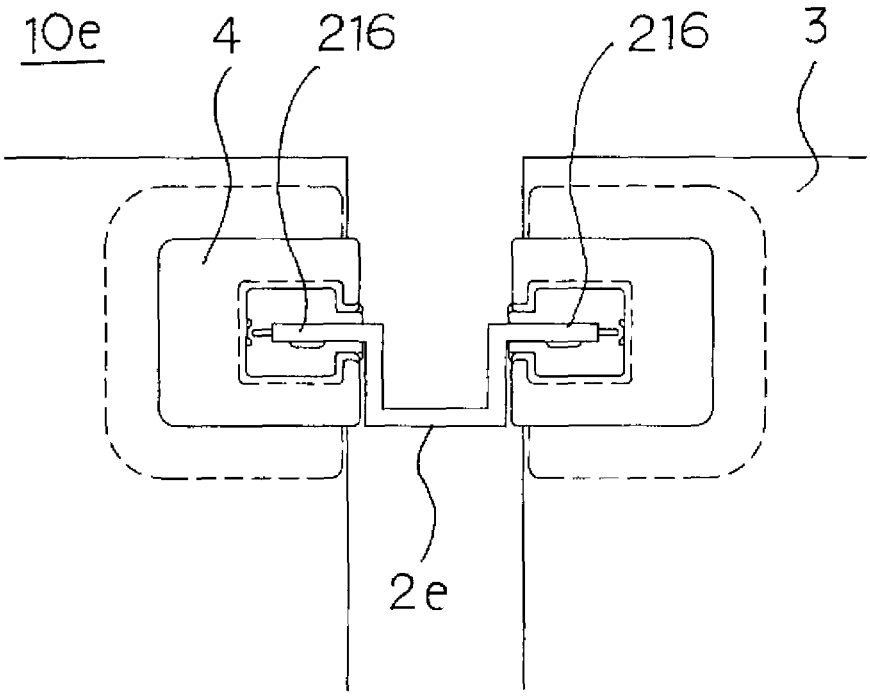

【Fig. 2 6】
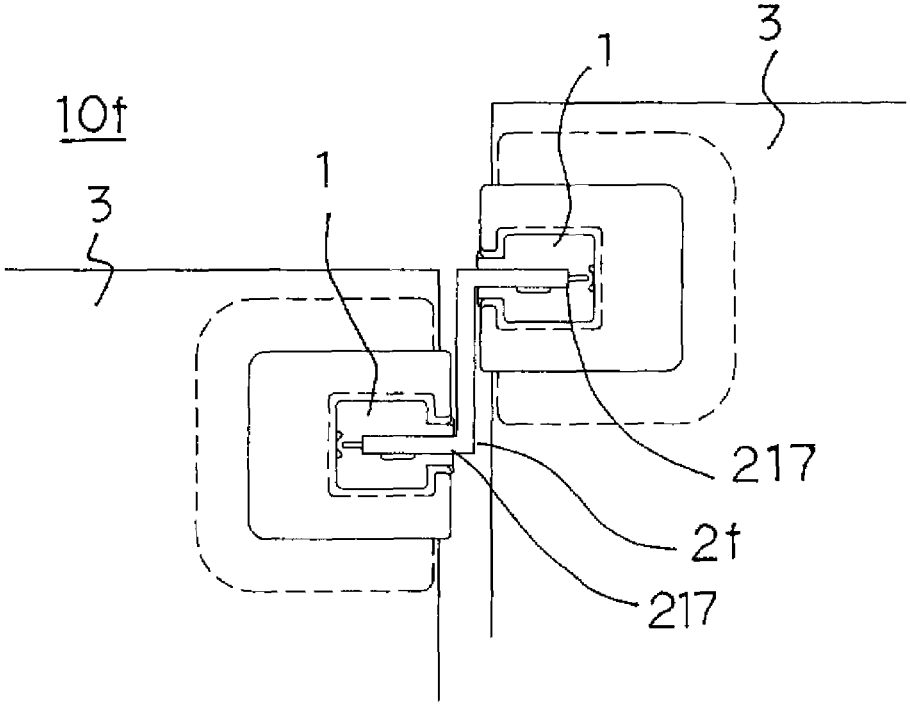

【Fig. 2 7】
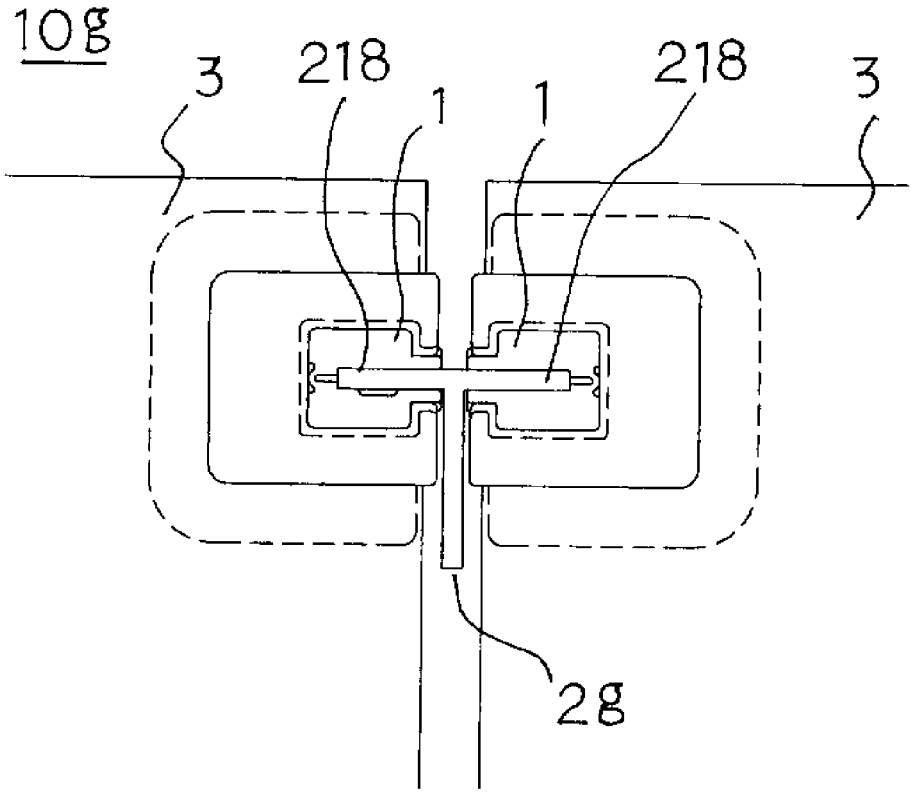

【Fig. 2 8】
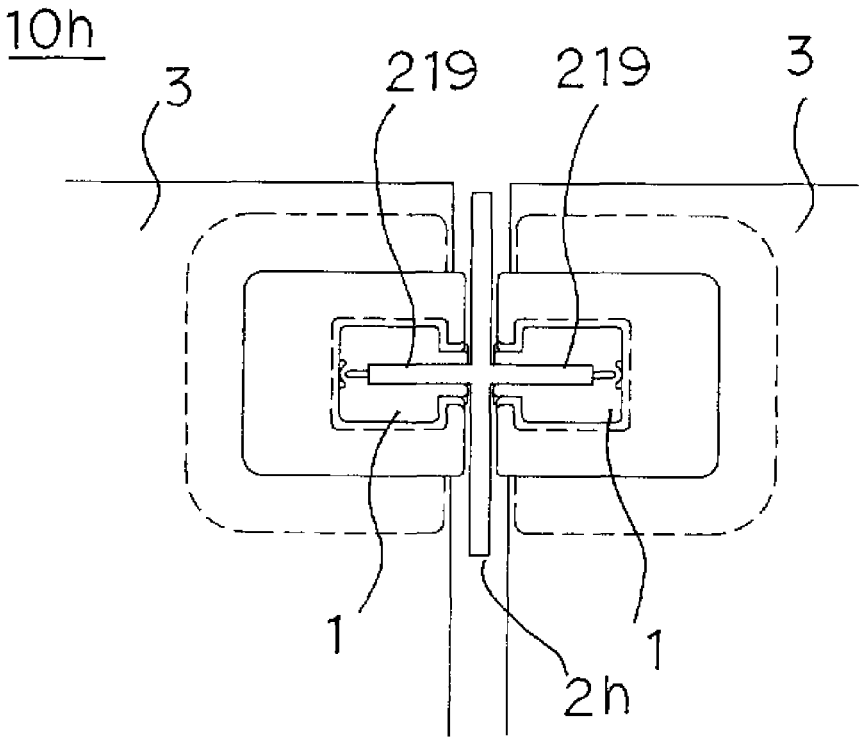

【Fig. 2 9】
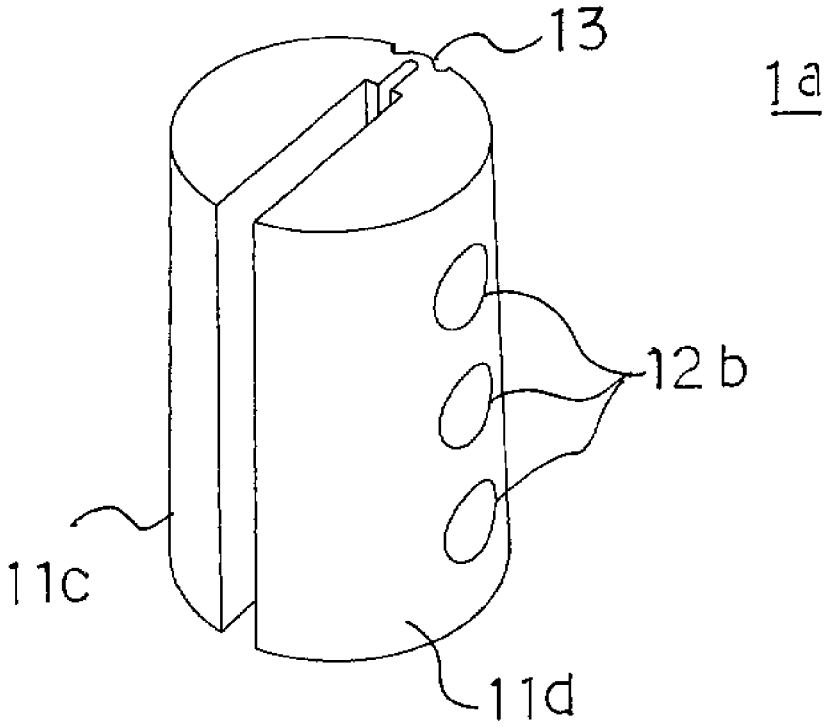

【Fig. 3 0】
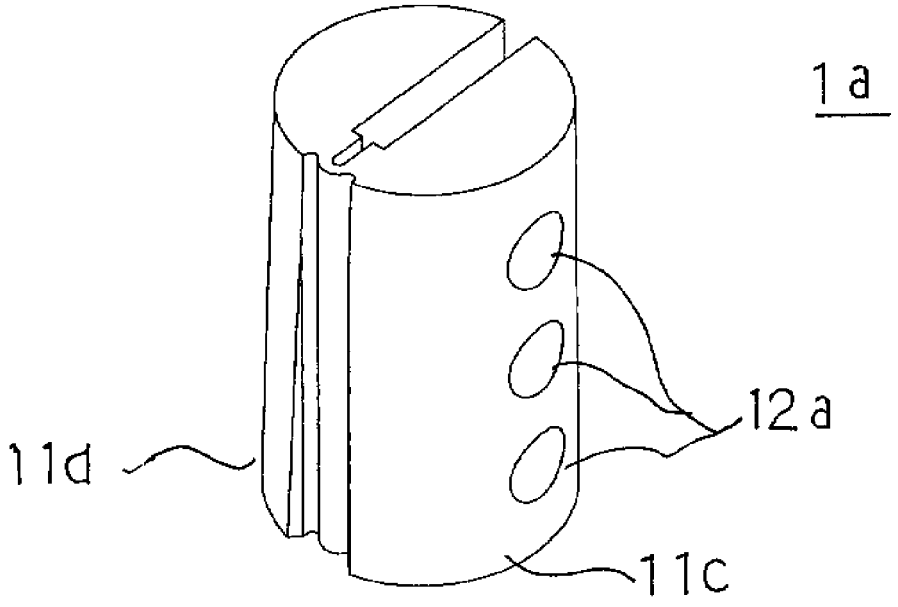

【Fig. 3 1】
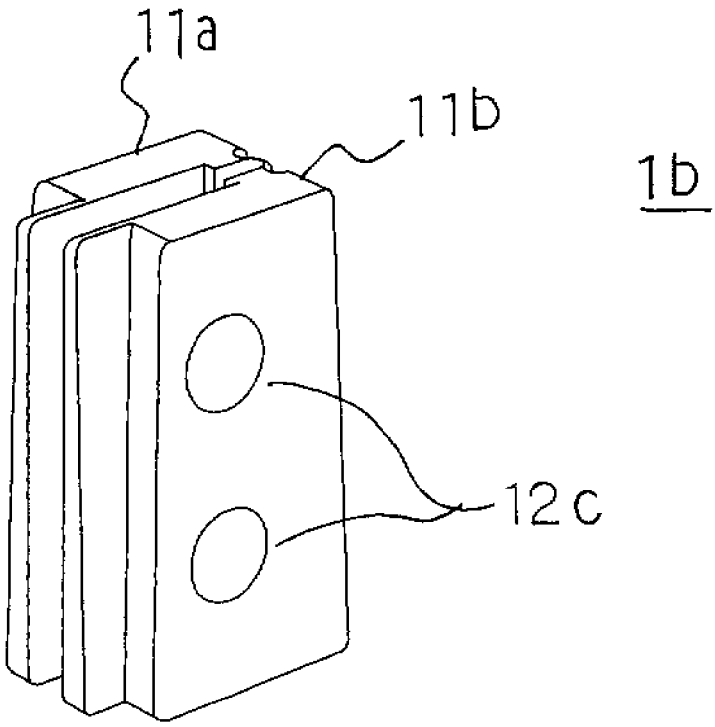

【Fig. 3 2】
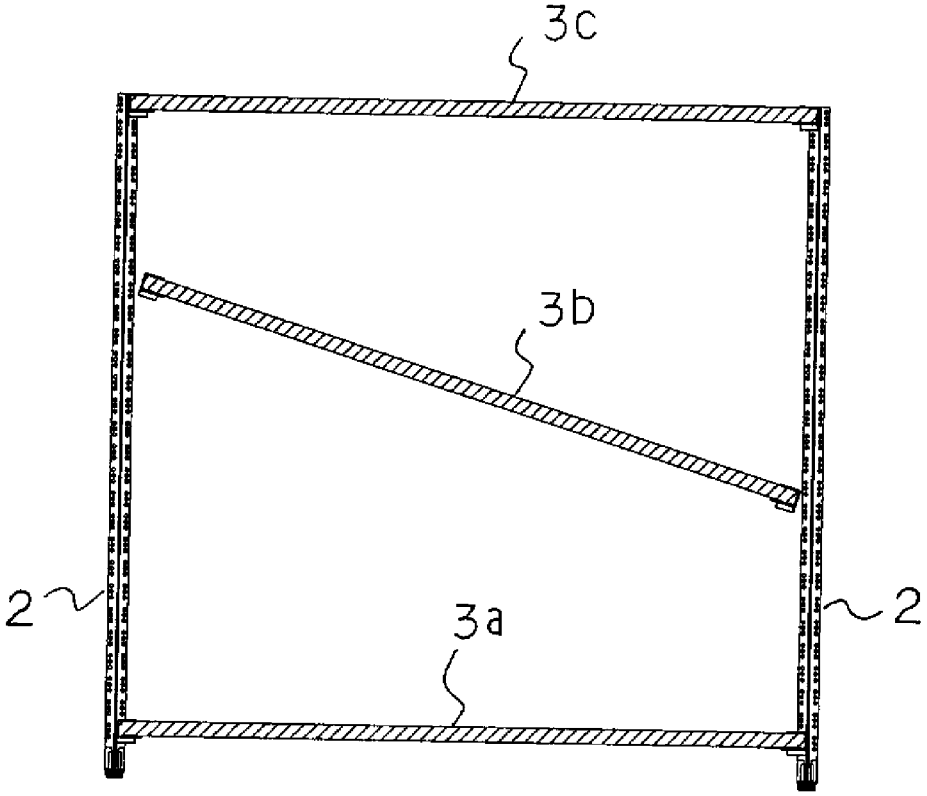

【Fig. 3 3】
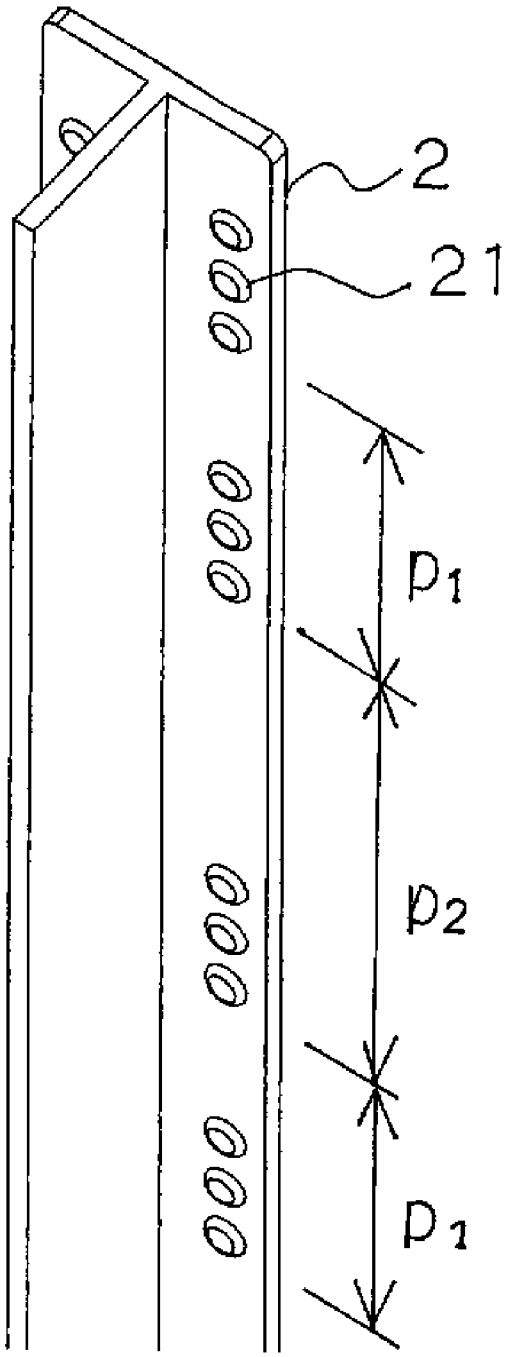

【Fig. 3 4】
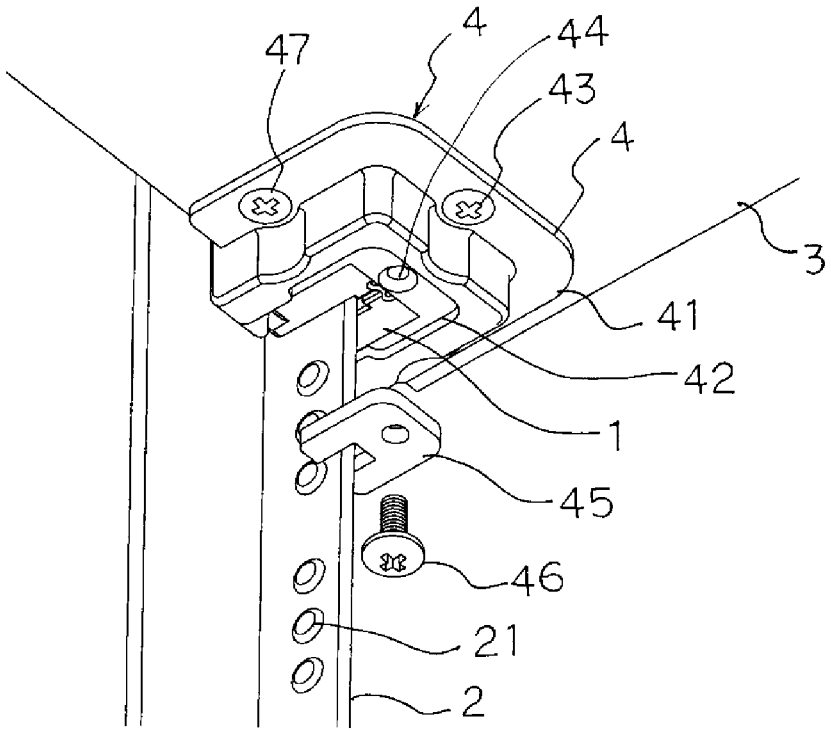

【Fig. 3 5】
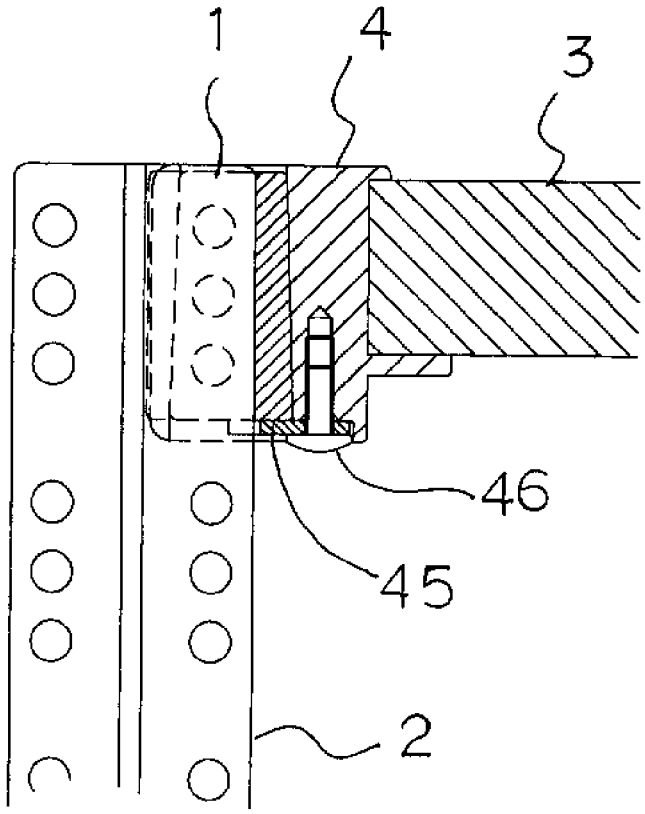

【Fig. 3 6】
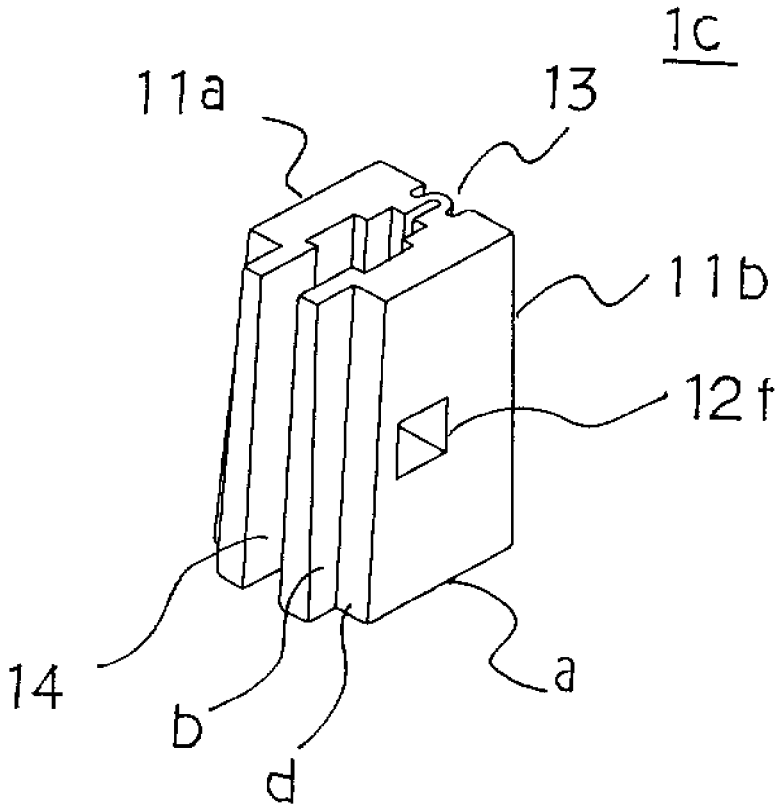

【Fig. 3 7】
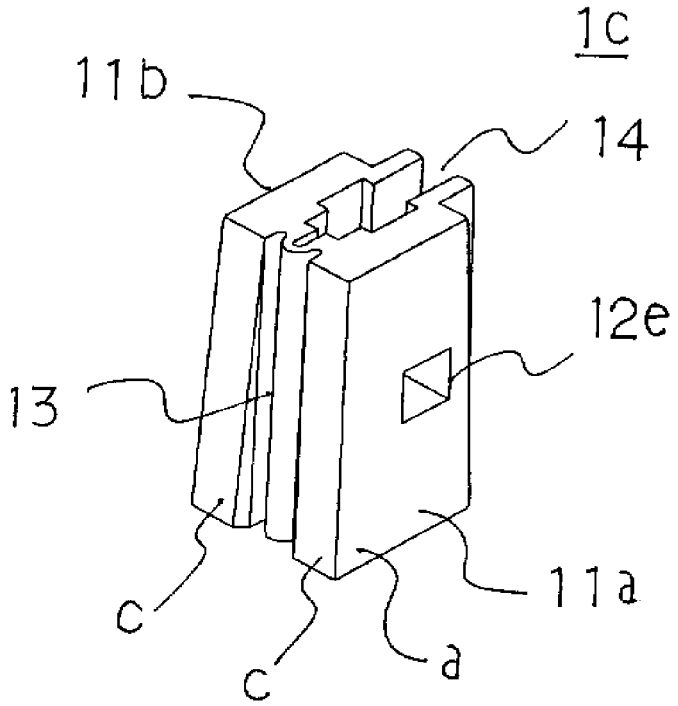

【Fig. 3 8】
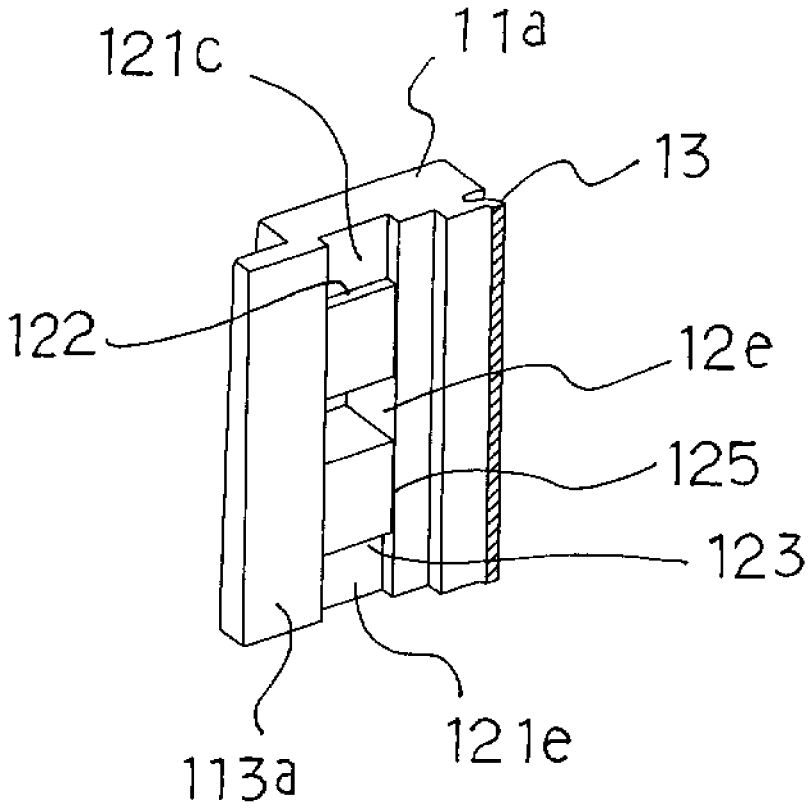

【Fig. 3 9】
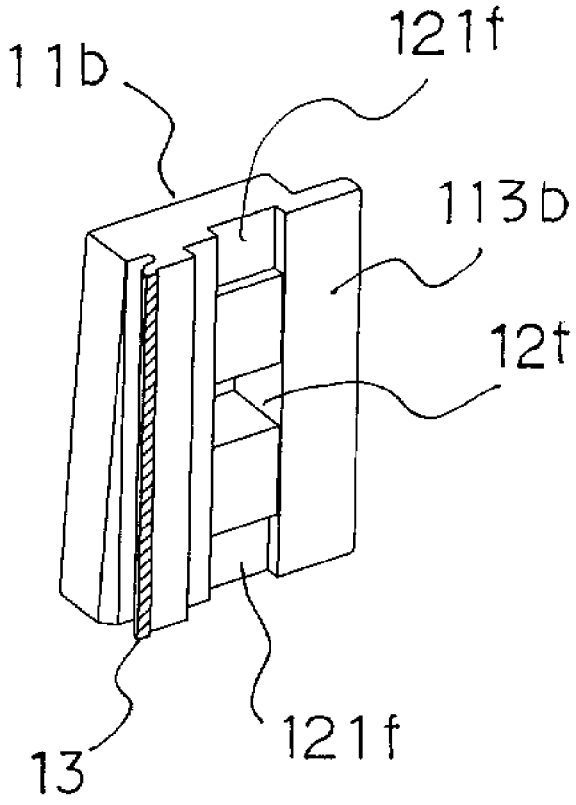

【Fig. 4 0】
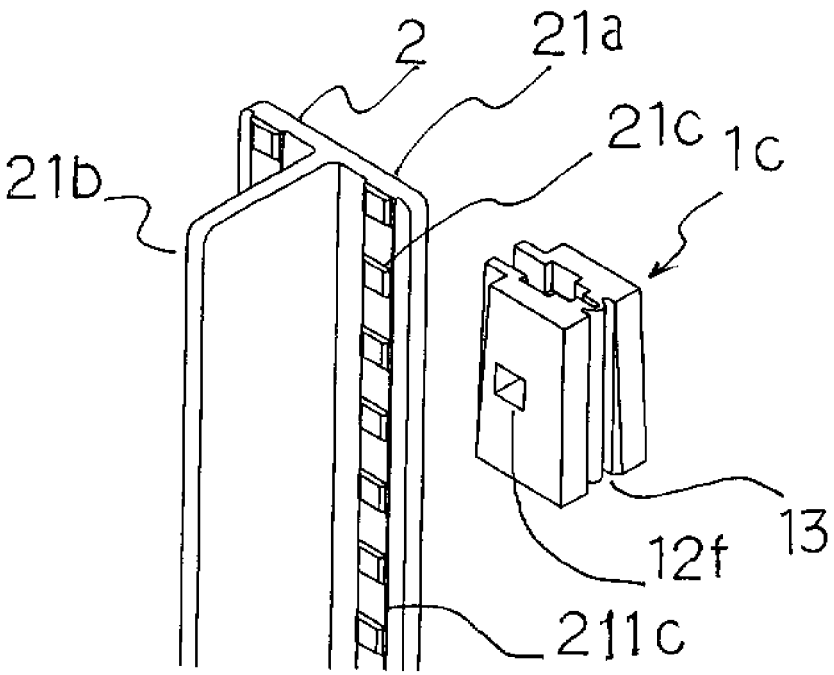

【Fig. 4 1】
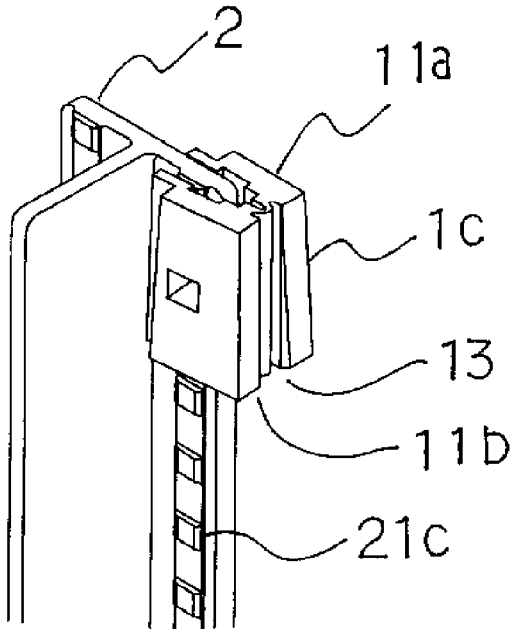

【Fig. 4 2】
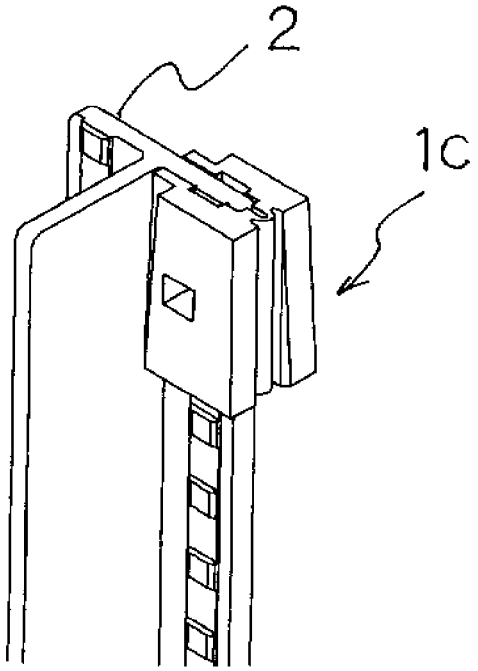

COUPLING MEMBER AND READY-TO-ASSEMBLE SHELVING THAT USES SAME

TECHNICAL FIELD

The present invention relates to a coupling member that is used for an assembly shelf such as a storage shelf that is used in an office, a home, a warehouse, a store, and the like, or a display shelf that is used in a store, and makes it possible to implement assembly and disassembly without using a tool, and an assembly shelf that utilizes the coupling member.

BACKGROUND ART

Assembly shelves that are obtained by assembling a shelf board member and a post are roughly classified into an assembly shelf that utilizes a post having a pipe-like shape, and an assembly shelf that utilizes a post having an L-angle shape. An assembly shelf that utilizes a post having an L-angle shape may be designed so that a protrusion (locking section) of the shelf board member is inserted into a fitting hole of the post (see JP-A-10-167075, JP-A-10-165233, and JP-A-2008-212414). JP-A-9-238758 discloses an assembly shelf that is designed so that a rectangular shelf board (that is formed by bending a steel sheet) is fitted to four posts having an L-angle shape using L-shaped metal fittings and bolts. These assembly shelves can be produced at low cost. The assembly shelf disclosed in JP-A-10-167075 is designed so that the shelf board member can be easily fitted and removed.

Japanese Utility Model Registration No. 3057990 discloses an assembly shelf that utilizes a post having a pipe-like shape. The assembly shelf disclosed in Japanese Utility Model Registration No. 3057990 utilizes a post that has a structure in which a plurality of circular locking grooves are formed in the outer circumferential surface in the longitudinal direction at given intervals, a tapered sleeve that is provided with an elongated protrusion (that is formed on the inner circumferential surface and engages with the locking groove of the post) and gradually slopes outward in the downward direction, and a shelf board member that is provided with a ring that is provided at each corner and fitted to the outer circumferential surface of the tapered sleeve. According to the assembly shelf disclosed in Japanese Utility Model Registration No. 3057990, two shelf board members can be linked in the longitudinal direction using the post in common, for example. Therefore, the assembly shelf has an excellent external appearance, and assembly is easy.

RELATED-ART DOCUMENT

Patent Document

Patent Document 1: JP-A-10-107075
Patent Document 2: JP-A-10-165233
Patent Document 3: JP-A-2008-212414
Patent Document 4: Japanese Utility Model Registration No. 3057990

SUMMARY OF THE INVENTION

Technical Problem

However, since the assembly shelf that utilizes a post having an L-angle shape is designed so that the shelf board member is provided with a looking (engagement) protrusion, the external appearance may be impaired, and the user may hurt his/her hand dating assembly. The assembly shelf that utilises L-shaped metal fittings and bolts requires a bolting tool during assembly (i.e., it is inconvenient). The assembly shelf disclosed in Japanese Utility Model Registration No. 3057990 has a problem in that, whets the assembly shelf is provided with a plurality of shelf board members that are arranged in the vertical direction, and it is desired to change the position of a middle shelf board member (hereinafter may be referred to as "middle shelf board removal operation"), it is necessary to remove the shelf board member(s) that is (are) provided above the middle shelf board member. Specifically, it is necessary to perform a complex operation in order to remove the middle shelf board (although assembly is easy).

An object of the invention is to provide a coupling member that is applied to a post having an L-angle shape, and an assembly shelf that utilizes the coupling member, the coupling member and the assembly shelf being configured so that the shelf board member is not provided with a protrusion, a tool is unnecessary during assembly, and the middle shelf board removal operation can be easily performed.

Solution to Problem

According to one aspect of the invention, a coupling member includes a pair of support members that are linked at one end so that an opening is formed therebetween at an opposite end, and back sides thereof are situated opposite to each other, and a pair of engagement holes that are respectively formed in the pair of support members, the pair of engagement holes respectively extending from the back sides in a thickness direction, the pair of support members having a tapered outer surface that gradually slopes outward in a downward direction.

In the coupling member according to one aspect of the invention, each of the pair of engagement holes may be a through-hole or a non-through-hole.

The coupling member according to one aspect of the invention may be formed of a metal, a resin, glass, carbon, or a composite thereof.

In the coupling member according to one aspect of the invention, the pair of support members may be linked by a link section having a small thickness.

In the coupling member according to one aspect of the invention, each of the pair of support members may include a first plate-like section that is situated on a side where the pair of support members are linked, and has an approximately plate-like shape, and a second plate-like section that is situated on a side where the pair of support members are not linked, and has an approximately plate-like shape, the second plate-like section being continuous with the first plate-like section so that a step is formed therebetween, and having a thickness smaller than that of the first plate-like section.

In the coupling member according to one aspect of the invention, two or more pairs of the engagement holes may be formed in a vertical direction.

In the coupling member according to one aspect of the invention, each of the pair of support members may have three or four continuous outer sides.

According to another aspect of the invention, an assembly shelf includes: the coupling member according to one aspect of the invention; a post that is shaped to have an L-shaped cross section, and includes a plate-like section that forms a letter L, a plurality of engagement protrusions being termed on the plate-like section in a longitudinal direction at regular or irregular intervals; and a shelf board member that includes an engagement section that engages with the coupling member, the coupling member being attached to the post so as to hold each side of the plate-like section in a state in which the engagement protrusion of the post engages with the engagement hole of the coupling member.

In the assembly shelf according to the other aspect of the invention, the post may have an L-shaped cross-sectional shape, a T-shaped cross-sectional shape, a cruciform cross-sectional shape, or a channel shape.

In the assembly shelf according to the other aspect of the invention, the post may have a T-shaped cross-sectional shape, and have a structure in which two plate-like sections that form a letter T and are situated opposite to each other are provided with a plurality of engagement protrusions that are formed in the longitudinal direction at regular or irregular intervals.

In the assembly shelf according to the other aspect of the invention, the engagement protrusions may have a height of 0.5 to 3 mm.

Advantageous Effects of the Invention

The assembly shelf according to one aspect of the invention makes it unnecessary to provide the shelf board member with a protrusion, and does not require an assembly tool during assembly. When a plurality of shelf board members have been fitted to the posts, and a middle shelf board member among the plurality of shelf board members and a shelf board member among the plurality of shelf board members that is situated immediately above the middle shelf board member are situated so that the middle shelf board member can be tilted, only the middle shelf board member can be removed or repositioned without removing the other shelf board members. Since the engagement protrusions having a small height are provided to the post instead of through-holes, a decrease in strength does not occur, and it is safe.

BRIEF DESCRIPTION OF DRAWING

FIG. 1 is a perspective view illustrating a coupling member (first embodiment).

FIG. 2 is another perspective view illustrating a coupling member (first embodiment).

FIG. 3 is a perspective view illustrating the coupling member illustrated in FIG. 1 (that is divided in two in the vertical direction).

FIG. 4 is a perspective view illustrating the coupling member illustrated in FIG. 1 (that is divided in two in the vertical direction).

FIG. 5 is a perspective view illustrating an assembly shelf (first embodiment).

FIG. 6 is a view illustrating posts and shelf board members before assembly (first embodiment).

FIG. 7 is a view illustrating a post and a coupling member before assembly (first embodiment).

FIG. 8 is a view illustrating a post and a coupling member during assembly (see FIG. 7).

FIG. 9 is a view illustrating a post and a coupling member after completion of assembly (see FIG. 8).

FIG. 10 is a plan view illustrating the state illustrated in FIG. 7.

FIG. 11 is a plan view illustrating the state illustrated in FIG. 8.

FIG. 12 is a plan view illustrating the state illustrated in FIG. 9.

FIG. 13 is a front view illustrating a state in which a coupling member has been attached to a post.

FIG. 14 is a right side view illustrating the state illustrated in FIG. 13.

FIG. 15 is a top view illustrating an engagement section of a shelf board member (first embodiment).

FIG. 16 is a cross-sectional view taken along the line X-X illustrated in FIG. 15.

FIG. 17 is a cross-sectional view taken along the line Y-Y illustrated in FIG. 15.

FIG. 18 is a left side view illustrating the state illustrated in FIG. 15.

FIG. 19 is a front view illustrating part of an assembly shelf (first embodiment).

FIG. 20 is a plan view illustrating the state illustrated in FIG. 19.

FIG. 21 is a plan view illustrating part of an assembly shelf (second embodiment).

FIG. 22 is a plan view illustrating part of an assembly shelf (second embodiment).

FIG. 23 is a plan view illustrating part of an assembly shelf (second embodiment).

FIG. 24 is a plan view illustrating part of an assembly shelf (third embodiment).

FIG. 25 is a plan view illustrating part of an assembly shelf (third embodiment).

FIG. 26 is a plan view illustrating part of an assembly shelf (third embodiment).

FIG. 27 is a plan view illustrating part of an assembly shelf (third embodiment).

FIG. 28 is a plan view illustrating part of an assembly shelf (third embodiment).

FIG. 29 is a perspective view illustrating a coupling member (fourth embodiment).

FIG. 30 is a perspective view illustrating the coupling member illustrated in FIG. 29.

FIG. 31 is a perspective view illustrating a coupling member (fourth embodiment).

FIG. 32 is a view illustrative of a middle shelf board removal operation.

FIG. 33 is a view illustrating engagement protrusions of a post.

FIG. 34 is a perspective view (exploded view) illustrating an engagement section of a shelf board member (back side).

FIG. 35 is a cross-sectional view illustrating part of an engagement section of a shelf board member.

FIG. 36 is a perspective view illustrating a coupling member (fifth embodiment).

FIG. 37 is a perspective view illustrating the coupling member illustrated in FIG. 36.

FIG. 38 is a perspective view illustrating the coupling member illustrated in FIG. 36 (that is divided in two in the vertical direction).

FIG. 39 is a perspective view illustrating the coupling member illustrated in FIG. 36 (that is divided in two in the vertical direction).

FIG. 40 is a perspective view illustrating a post and a coupling member before assembly (fifth embodiment).

FIG. 41 is a view illustrating a post and a coupling member during assembly (see FIG. 40).

FIG. 42 is a view illustrating a post and a coupling member after completion of assembly (see FIG. 41).

DESCRIPTION OF EMBODIMENTS

Coupling Member

A coupling member according to a first embodiment of the invention is described below with reference to FIGS. 1 to 4. A coupling member 1 according to the first embodiment is attached (fitted) to a post 2, and supports a shelf board member 3. The coupling member 1 is formed of a metal, a resin, glass, carbon, or a composite thereof. It is preferable that the coupling member 1 be formed of a resin since metal noise or the like does not occur during assembly, and assembly is facilitated. An engineering plastic (e.g., polyacetal resin, polyamide resin, acrylonitrile-butadiene-styrene copolymer resin (ABS resin), epoxy resin, phenol resin, or polycarbonate resin) may be used as the resin. These synthetic resins exhibit excellent impact resistance, excellent wear resistance, and excellent chemical resistance. Note that the resin may include reinforcing fibers such as glass fibers or carbon fibers.

As illustrated in FIGS. 1 and 2, the coupling member 1 includes a pair of support members 11*a* and 11*b* that are linked at one end so that an opening is formed at the opposite end, and back sides 113*a* and 113*b* thereof are situated opposite to each other, and a pair of engagement holes 12*a* and 12*b* that are respectively formed in the back sides 113*a* and 113*b* of the support members 11*a* and 11*b* so as to extend in the thickness direction, and are situated opposite to each other. The number of engagement holes (12*a* or 12*b*) formed in each support member is not particularly limited. The number of engagement holes formed in each support member in the vertical direction is normally 2 or more, and preferably 3 to 5. In the first embodiment, three engagement holes are formed in each support member. If the number of engagement holes (12*a*, 12*b*) formed in each support member is 1, it may be difficult to sufficiently support the shelf board member 3. If the number of engagement holes (12*a*, 12*b*) formed in each support member is 6 or more, it may be necessary to increase the length of the coupling member 1 in the vertical direction, and the material cost may increase. FIG. 31 illustrates an example of the coupling member in which two engagement holes (12*c*) are formed in the support member.

The shape of the engagement holes 12*a* and 12*b* is not particularly limited as long as an engagement protrusion 21 of the post 2 is relatively tightly fitted into the engagement hole. For example, the engagement holes 12*a* and 12*b* may be through-holes having a circular cross-sectional shape (see FIGS. 1 and 2). The inner diameter of the engagement holes 12*a* and 12*b* (through-holes) is almost equal to or slightly larger than the outer diameter of the engagement protrusion 21 of the post 2. If the inner diameter of the engagement holes 12*a* and 12*b* is significantly larger than the outer diameter of the engagement protrusion 21, the engagement protrusion 21 may not be tightly fitted into the engagement hole, and it may impossible to correctly position the shelf board member 3. The engagement hole is not limited to a through-hole. The engagement hole may be a non-through-hole that has a depth larger than the height of the protrusion 21 of the post 2. Examples of the non-through-hole include a concavity (recess or depression). The shape of the engagement hole is not limited to the above shape. For example, the engagement hole may have a gear-like (rack tooth-like) shape in which convexities and concavities are regularly formed.

The pair of support members 11*a* and 11*b* have a symmetrical shape with respect to a link section 13. The following description focuses on the support member 11*b*. The support member 11*b* includes a first plate-like section 111*b* that is situated on the side of the link section, and has an approximately plate-like shape, and a second plate-like section 112*b* that is situated on the side opposite to the link section, and has an approximately plate-like shape, the second plate-like section 112*b* being continuous with the first plate-like section 111*b* so that a step is formed therebetween, and having a thickness smaller than that of the first plate-like section 111*b*. The second plate-like section 112*b* (that has a thickness smaller than that of the first plate-like section 111*b*) prevents a situation in which an end face 412 of an engagement section 4 of the shelf board member 3 comes in direct contact with the surface of the plate-like section of the post 2. The engagement section 4 is normally formed of a metal. If the second plate-like section 112*b* is not provided, the engagement section 4 comes in direct contact with the post 2, and the post 2 may be damaged. When the second plate-like section 112*b* (that has a thickness smaller than that of the first plate-like section 111*b*) is provided, the engagement section 4 of the shelf board member 3 engages with four sides (outer sides) of the support member 11*b* that extend in the vertical direction (i.e., the area of contact with the engagement section 4 increases), and the fitting strength is improved. Note that the four sides of the support member 11*b* that extend in the vertical direction refer to the front side a of the first plate-like section 111*b*, the front side b of the second plate-like section 112*b*, the right side c of the first plate-like section 111*b*, and the left side d of the first plate-like section 111*b* (see FIG. 1) when the side of the coupling member 1 illustrated in FIG. 13 is the front side. The four sides of the support member 11*b* that extend in the vertical direction are continuous with each other. The through-hole 12*b* is formed in the first plate-like section 111*b*.

The outer sides a to d of the support member 11*b* form a tapered surface that gradually slopes outward in the downward direction. Therefore, when the engagement section 4 of the shelf board member 3 is fitted to the coupling member 1, the downward movement of the shelf board member 3 is restricted by contact between the tapered surfaces, and the shelf board member 3 can be secured on the coupling member 1 that is secured on the post 2. When the support members 11*a* and 11*b* (that make a pair) have a plate-like shape, the outer sides of the coupling member 1 refer to the front side a of the support member 11*a* and the front side a of the support member 11*b* (preferably the sides a to d of the support member 11*a* and the sides a to d of the support member 11*b*). A sufficient support effect is achieved even when only two outer sides form a tapered surface that gradually slopes outward in the downward direction. A sufficient tightening force can be obtained when the taper angle of the outer sides a to d is set to about 2 to 3°. The support members 11*a* and 11*b* (that make a pair) have a flat contact surface (excluding the engagement holes 12*a* and 12*b*). Therefore, the support members 11*a* and 11*b* closely come in contact with the plate-like section of the post 2.

The support members 11*a* and 11*b* (that make a pair) are linked at one end at which the opening is not formed. The link section 13 is a hinge that is formed of a resin and has a small thickness. The link section 13 may link the support members 11*a* and 11*b* so that the opening can be opened and closed, or link the support members 11*a* and 11*b* so that the support members 11*a* and 11*b* move outward when the coupling member 1 is fitted to the post 2. It is preferable that the link section 13 link the support members 11*a* and 11*b* so that the support members 11*a* and 11*b* move outward when the coupling member 1 is fitted to the post 2 since a temporally fitted state (see FIG. 13) can be maintained. The link section 13 is hidden behind the support members 11*a* and 11*b* (that make a pair) when viewed from the front side. Specifically, the end of the link section 13 does not protrude from the end of the support members 11*a* and 11*b* (that make a pair) at which the support members 11*a* and 11*b* are linked.

Therefore, an inner wall 414 of the engagement section 4 of the shelf board member comes in contact with the side c of each of the support members 11*a* and 11*b* (that make a pair). The support members 11*a* and 11*b* (that make a pair) are respectively provided with link-side thick sections 114*a* and 114*b* (that are formed on the side where the support members 11*a* and 11*b* are linked) so that a stop is formed on the back side of each of the support members 11*a* and 11*b*. The link-side thick sections 114*a* and 114*b* allow the opening to have a constant width w, and allow the back sides of the support members 11*a* and 11*b* to be situated opposite to each other approximately in parallel (see FIG. 1). Specifically, the support members 11*a* and 11*b* (that make a pair and have an approximately plate-like shape) are situated opposite to each other at an interval w, and linked at one end.

Assembly Shelf

An assembly shelf according to the first embodiment is described below with reference to FIGS. 5 to 20. An assembly shelf 10 is assembled using the coupling member 1, the post 2, and the shelf board member 3. The post 1 is shaped to have an L-shaped cross section. For example, the post 1 has an L-shaped cross-sectional shape, a T-shaped cross-sectional shape, a cruciform cross-sectional shape, or a channel shape (U-shaped cross-sectional shape), and has a given length (height). When the post 2 has such a shape, the post 2 exhibits excellent strength and excellent placement stability, and can be produced at low cost. Note that the post 1 excludes a hollow tube such as a pipe.

The post 2 has a structure in which the plate-like section (that forms the letter L and has a side edge) is provided with a plurality of engagement protrusions that are formed in the longitudinal direction (height direction) at regular or irregular intervals. The plate-like section (that forms the letter L and has a side edge) refers to two plate-like sections that form the letter L when the post 2 has an L-shaped cross-sectional shape. The plate-like section (that forms the letter L and has a side edge) refers to three plate-like sections that extend in three directions from the intersection of the two lines mat form the letter T when the post 2 has a T-shaped cross-sectional shape. The plate-like section (that forms the letter L and has a side edge) refers to four plate-like sections that extend in four directions from the intersection of the two lines that form a cross when the post 2 has a cruciform cross-sectional shape. The plate-like section (that forms the letter L and has a side edge) refers to two plate-like sections that are opposite to each other when the post 2 has a channel shape (U-shaped cross-sectional shape). The engagement protrusions 21 are formed on at least one of these plate-like sections. In the first embodiment, the post 2 has a T-shaped cross-sectional shape, and the engagement protrusions 21 are formed on two plate-like sections that extend in the horizontal direction from the intersection of the two lines that form the letter T. When the engagement protrusions 21 are formed at irregular intervals, a plurality of sets of engagement protrusions 21 (that are fitted into the engagement holes 12 of the coupling member 1) are formed at a pitch of p1 or p2 (either arbitrarily or alternately) (see FIG. 33), for example. Note that the pitch p1 differs from the pitch p1 of two engagement through-holes 11.

The engagement protrusions 21 of the post 2 are fitted into the engagement holes 12 of the coupling member 1. The attachment position of the coupling member 1 (i.e., the placement position of the shelf board member 3) can be arbitrarily set by forming a plurality of engagement protrusions 21 in the longitudinal direction. The engagement protrusions 21 may be formed on either side or each side of the plate-like section (21*a*). When the engagement protrusions 21 are formed on the back side (i.e., the inner side of the shell) of the plate-like section 21*a*, the engagement protrusions 21 are not observed from the outer side, and an excellent external appearance can be obtained.

The engagement protrusion 21 is in the shape of a short column, and gradually decreases in diameter (i.e., is gradually tapered) toward the end thereof. The height of the engagement protrusion 21 is preferably 0.5 to 3.0 mm, more preferably 0.5 to 2.0 mm, and particularly preferably 0.5 to 1.5 mm. The engagement protrusion 21 is fitted into the engagement hole 12 of the coupling member 1 to support the shelf board member 3. The outer diameter of the engagement protrusion 21 is equal to or slightly smaller than the inner diameter of the engagement hole 12 of the coupling member 1. If the outer diameter of the engagement protrusion 21 is larger than the inner diameter of the engagement hole 12 of the coupling member 1, it may be difficult to fit the engagement protrusion 21 into the engagement hole 12 of the coupling member 1. If the outer diameter of the engagement protrusion 21 is significantly smaller than the inner diameter of the engagement hole 12 of the coupling member 1, it may be difficult to correctly position the shelf board member 3. The distance between the engagement protrusion 21 and the side of the post 2 is determined taking account of the relationship with the position of the engagement hole 12 of the coupling member 1. The shape of the engagement protrusion 21 is not limited to the above shape. For example, the engagement protrusion 21 may have a gear-like (rack tooth-like) shape in which convexities and concavities are regularly formed, or may have a short quadrangular prism shape.

The shelf board member 3 includes the engagement section 4 that engages with the coupling member 1. The engagement section 4 may be formed at an arbitrary position of the shelf board member 3. It is preferable that the engagement section 4 be formed around each corner of the shelf board member 3. When the engagement section 4 is formed at each corner of the shelf board member 3, the area (placement area) formed by four posts 1 can be increased, and the assembly shelf 10 can be placed in a stable manner. The main part of the shelf board member 3 may have a board-like structure or a net-like structure. The shape of the shelf board member 3 is not particularly limited. The shelf board member 3 normally has a rectangular shape in a plane view.

The engagement section 4 includes an engagement main body 411 that has an internal shape that corresponds to the external shape of the coupling member 1, and extends through the shelf board member 3 in the vertical direction. As illustrated in FIG. 15, the engagement main body 411 has a rectangular internal shape in a plan view, and has an opening 412 that is formed at the edge thereof, and has a width slightly larger than the thickness of the plate-like section 21*a*. Therefore, the assembly shelf 10 can be assembled by moving the engagement section 4 of the shelf board member 3 downward with respect to the post 2 to which the coupling member 1 is attached.

As illustrated in FIGS. 15 and 16, inner walls 413 of the engagement main body 411 that extend in parallel with the longitudinal direction of the shelf board member 3 come in contact with the outer side a of each of the support members 11*a* and 11*b* (that make a pair) of the coupling member 1, and form a tapered surface in the same manner as the outer side a of each of the support members 11*a* and 11*b*. As illustrated in FIG. 117, the inner walls 414 of the engagement main body 411 that extend in parallel with the lateral direction of the shelf board member 3 come in contact with the outer sides c and d of each of the support members 11*a* and 11*b* (that make a pair) of the coupling member 1, and form a tapered surface in the same manner as the outer sides c and d of each of the support members 11*a* and 11*b*. As illustrated in FIGS. 15 and 18, inner walls 415 of the engagement main body 411 that are situated opposite to each other through the opening 412 come in contact with the outer side b of each of the support members 11*a* and 11*b* (that make a pair) of the coupling member 1, and form a tapered surface in the same manner as the outer side b of each of the support members 11*a* and 11*b*. The height of the engagement main body 411 is equal to or slightly larger than that of the coupling member 1. Therefore, the coupling member 1 is not observed from the outside after the shelf board member 3 has been fitted to the coupling member 1, and an excellent external appearance can be obtained.

The coupling member 1 is attached to the post 2 so as to hold each side of the plate-like section 21*a* of the post 2 in a state in which the engagement protrusions 21 of the post 2 engage with (are fitted into) the engagement holes 12 (see FIG. 9). The back side of each of the support members 11*a* and 11*b* (that make a pair) comes in contact with either side of the plate-like section 21*a*. Note that the end of the engagement protrusions 21 does not protrude outward from the engagement holes 12 when the engagement protrusions 21 are fitted into the engagement holes 12. If the end of the engagement protrusions 21 protrudes outward from the engagement holes 12, the engagement section 4 of the shelf board member cannot engage with the coupling member 1.

The coupling member 1 illustrated in FIGS. 7 to 9 is applied to the posts 2*j* and 2*m* illustrated in FIG. 5. Since the engagement holes 12 are formed in each of the support members 11*a* and 11*b* (that make a pair), the coupling member 1 can also be applied to the posts 2*k* and 2*l* that are situated opposite to the posts 2*j* and 2*m* in the longitudinal (lateral) direction of the shelf board member. When the coupling member 1 is used for the posts 2*k* and 2*l*, the engagement protrusions 21 of the post 2*k* engage with the engagement holes 12*a* of the support member 11*a*, and the engagement protrusions 21 of the post 2*l* engage with the engagement holes 12*a* of the support member 11*a*. Specifically, the coupling member 1 according to the first embodiment can be used even when the engagement protrusions 21 are formed on a different side of the plate-like section of the post 2.

The assembly shelf 10 according to the first embodiment is assembled as described below. The coupling member 1 is attached to the desired position of the post 2 (see FIG. 6). Specifically, the coupling member 1 is held so that the opening 14 faces the end of the plate-like section 21*a* of the post 2, and pressed against the plate-like section 21*a* (see FIGS. 7 and 8). Since the interval (open width) w between the support members 11*a* and 11*b* (that make a pair) is approximately the same as the thickness of the plate-like section 21*a*, the end of the plate-like section 21*a* enters the opening 14 of the coupling member 1. When the coupling member 1 is moved further forward, the end of the support member 11*b* comes in contact with the engagement protrusions 21, and moves beyond the engagement protrusions 21 (i.e., moves outward) due to the hinge or leaf spring action of the link section 13 so that the engagement protrusions 21 are fitted into the engagement holes 12*b* (see FIGS. 8 and 9). The coupling member 1 is attached to the remaining posts 2 in the same manner as described above.

The engagement sections 4 of the shelf board member 3 are then caused to engage with the coupling members 1. Specifically, the shelf board member 3 is moved downward relative to the coupling members 1 so that the engagement sections 4 of the shelf board member 3 engage with the coupling members 1 (see FIG. 6). Since the width of the opening 412 of the engagement section 4 is larger than the thickness of the plate-like section 21*a* of the post 2, and the size of the lower opening of the engagement main body 411 of the engagement section 4 is larger than the size of the upper end of the coupling member 1, the coupling member 1 enters the engagement main body 411. In this case, the tapered surfaces a of the coupling member 1 come in contact with the tapered surfaces 413 of the engagement main body 411, the tapered surfaces c and d of the coupling member 1 come in contact with the tapered surfaces 414 of the engagement main body 411, and the tapered surfaces b of the coupling member 1 come in contact with the tapered surfaces 415 of the engagement main body 411. Therefore, the coupling member 1 is tightly fitted to the engagement section 4 (see FIGS. 15 to 19). The coupling member 1 and the shelf board member 3 can thus be fitted (attached) to the post 2 without using a tool. Since the shelf board member 3 is not provided with an engagement protrusion, the worker is not injured during handling, for example.

The lowermost shelf board member 3*a* and the middle shelf board member 3*b* illustrated in FIG. 5 are fitted as described below. The coupling member 1 is attached to the post 2 in the same manner as described above. The shelf board member 3 is then fitted to the coupling member 1. Specifically, the shelf board member 3 is tilted and placed (from the front side) under the shelf board member 3 that has been fitted (e.g., the lowermost shelf board member 3*a* is placed under the middle shelf board member 3*b* in a tilted state, and the middle shelf board member 3*b* is placed under the uppermost shelf board member 3*c*), and placed horizontally so that the plate-like section 21*a* of each post 2 eaters the opening 412 of each engagement section 4. The shelf board member 3 (3*a* or 3*b*) is then fitted to the coupling members 1 in the same manner as described above. When the shelf board member 3 cannot be placed under another shelf board member 3 in a tilted state, the shelf board member 3 is fitted before fitting another shelf board member 3 that is situated above. The assembly shelf 10 illustrated in FIG. 5 is thus obtained.

The assembly shelf 10 is disassembled as described below. The shelf board members 3 are sequentially removed in order from the uppermost shelf board member 3. Each shelf board member 3 is removed by moving the shelf board member 3 upward so that the shelf board member 3 disengages from the coupling members 1, and removing the shelf board member 3 from the posts 2. When removing only the middle shelf board member 3*b* from the assembly shelf 10 illustrated in FIG. 5, the middle shelf board member 3*b* is tilted and removed forward. Note that the middle shelf board member 3*b* can be removed as long as the space between the middle shelf board member 3*b* and the upper shelf board member 3*a* is sufficient for removal. Specifically, the middle shelf board member 3*b* is moved upward so that the shelf board member 3*b* disengages from the coupling members 1, tilted, and removed forward (see FIG. 32). FIG. 20 illustrates an example of the positional relationship between the post 2 having a T-shaped cross-sectional shape and the shelf board member 3. Note that the post 2 may be placed in an inverted state, and the coupling member 1 may be caused to engage with the engagement protrusions 21*a*.

The assembly shelf 10 according to the first embodiment has the following advantages. Since the shelf board member 3 is not provided with a protrusion, a hand injury does not occur during assembly, and it is unnecessary to use an assembly tool. When the post 2 has a T-shaped cross-sectional shape (T-angle), the post 2 exhibits excellent placement stability, and can be produced at low cost. When a plurality of shelf board members have been fitted to the posts, and a middle shelf board member among the plurality of shelf board members and a shelf board member among the plurality of shelf board members that is situated immediately above the middle shelf board member are situated so that the middle shelf board member can be tilted, only the middle shelf board member can be removed or repositioned without removing the other shelf board members.

An assembly shelf according to a second embodiment of the invention is described below with reference to FIGS. 21 to 23. In FIGS. 21 to 23, the same elements as those illustrated in FIGS. 1 to 20 are indicated by the same reference signs (symbols), and description thereof is omitted. The following description mainly focuses on the differences from the assembly shelf 10. The assembly shelf (10*a* to 10*c*) according to the second embodiment differs from the assembly shelf 10 according to the first embodiment as to the shape of the post 2. As illustrated in FIG. 21, the assembly shelf 10*a* includes a post 2*a* that has an L-shaped cross-sectional shape, and the engagement protrusions are formed on one plate-like section 211 that forms the letter L. Note that the other plate-like section that forms the letter L extends in the direction parallel to the side of the shelf board member 3. As illustrated in FIG. 22, the assembly shelf 10*b* includes a post 2*b* that has a cruciform cross-sectional shape, and the engagement protrusions are formed on one plate-like section 212 that forms the cross. As illustrated in FIG. 23, the assembly shelf 10*c* includes a post 2*b* that has a U-shaped cross-sectional shape (channel shape), and the engagement protrusions are formed on one plate-like section 213 that forms the letter U. The assembly shelves 10*a* to 10*c* can achieve the same advantageous effects as those achieved by the assembly shelf 10. Note that a plate-like section 213*a* that forms the letter U and is situated opposite to the plate-like section 213 is situated outside the shelf board member 3, and extends in the direction parallel to the side of the shelf board member 3 that extends in the longitudinal direction.

An assembly shelf according to a third embodiment of the invention is described below with reference to FIGS. 24 to 28. In FIGS. 24 to 28, the same elements as those illustrated in FIGS. 1 to 20 are indicated by the same reference signs (symbols), and description thereof is omitted. The following description mainly focuses on the differences from the assembly shelf 10. The assembly shelf (10*d* to 10*h*) according to the third embodiment differs from the assembly shelf 10 according to the first embodiment as to the number of coupling members 1, the number of shelf board members 3, and the shape of the post 2. Specifically, the assembly shelf 10*d* is designed so that two shelf board members 3 are linked by one post 2*d* (see FIG. 24). The post 2*d* has an L-shaped cross-sectional shape, and the engagement protrusions are formed on two plate-like sections 214 that form the letter L. Note that the plate-like sections 214 of the post 2*d* that form the letter L are longer than the plate-like sections of the post 2*a* that form the letter L. This makes it possible to link two shelf board members 3. The assembly shelf 10*d* is designed so that the engagement sections 4 of the shelf board members 3 and the coupling members 1 are situated to be orthogonal to each other due to the shape (L-shape) of the post 2*d*.

The assembly shelf 10*e* is designed so that two shelf board members 3 are linked by one post 2*e* (see FIG. 25). The post 2 has a shape in which flanges 216 extend outward from the end of each of opposite sides that form a U-shaped cross-sectional shape in the direction orthogonal thereto. The engagement protrusions are formed on the flanges 216 (plate-like sections). This makes it possible to link two shelf board members 3. The assembly shelf 10*e* is designed so that the flanges 216 of the post 2*e* extend in opposite directions, and two assembly shelves are linked in the longitudinal direction.

The assembly shelf 10*f* is designed so that two shelf board members 3 are linked by one post 2*f* (see FIG. 26). The post 2*f* has a crank shape in which flanges extend outward from one side that forms the letter L, and the engagement protrusions are formed on two sides 217 (plate-like sections) that extend in parallel with each other. This makes it possible to link two shelf board members 3. The assembly shelf 10*f* is designed so that the two sides 217 of the post 2*f* extend in opposite directions, and two assembly shelves are linked in the longitudinal direction.

The assembly shelf 10*g* is designed so that two shelf board members 3 are linked by one post 2*g* (see FIG. 27). The post 2*g* has a T-shaped cross-sectional shape, and the engagement protrusions are formed on two plate-like sections 218 that form the letter T and are situated opposite to each other. This makes it possible to link two shelf board members 3. The assembly shelf 10*g* is designed so that the two plate-like sections 218 of the post 2*g* extend in opposite directions, and two assembly shelves are linked in the longitudinal direction.

The assembly shelf 10*h* is designed so that two shelf board members 3 are linked by one post 2*h* (see FIG. 28). The post 2*h* has a cruciform cross-sectional shape, and the engagement protrusions are formed on two plate-like sections 219 that form the cross and are situated opposite to each other. This makes it possible to link two shelf board members 3. The assembly shelf 10*h* is designed so that the two plate-like sections 219 of the post 2*h* extend in opposite directions, and two assembly shelves are linked in the longitudinal direction. The assembly shelves 10*d* to 10*h* can achieve the same advantageous effects as those achieved by the assembly shelf 10.

An assembly shelf according to a fourth embodiment of the invention is described below with reference to FIGS. 29 to 31. In FIGS. 29 to 31, the same elements as those illustrated in FIGS. 1 and 2 are indicated by the same reference signs (symbols), and description thereof is omitted. The following description mainly focuses on the differences from the assembly shelf 10. The assembly shelf according to the fourth embodiment differs from the assembly shelf 10 according to the first embodiment as to the shape of the coupling member 1 and the shape of the engagement section of the shelf board member 3. A coupling member 1*a* is designed so that support members 11*c* and 11*d* that make a pair have a semi-conical external shape, and has a circular shape in a plan view. The outer side of the support members 11*e* and 11*d* (that make a pair) form a tapered surface that gradually slopes outward in the downward direction. Note that the engagement section of the shelf board member 3 has a shape corresponding to the shape of the coupling member 1*a* (i.e., the engagement main body has a circular internal shape in a plan view). The assembly shelf that includes the coupling member 1*a* can achieve the same advantageous effects as those achieved by the assembly shelf 10.

An assembly shelf according to a fifth embodiment of the invention is described below with reference to FIGS. 36 to 42. In FIGS. 36 to 42, the same elements as those illustrated in FIGS. 1, 2, and 7 to 9 are indicated by the same reference signs (symbols), and description thereof is omitted. The following description mainly focuses on the differences from the assembly shelf 10. The assembly shelf according to the fifth embodiment differs from the assembly shelf 10 according to the first embodiment as to the shape of the engagement hole of the coupling member 1 and the shape of the engagement protrusion of the shelf board member 3. Engagement protrusions 21*c* of the post 2 have a short quadrangular prism shape. The engagement protrusions 21*c* are angled in the direction in which the coupling member is inserted and removed. This facilitates engagement with engagement holes 12*e* and 12*f* of the coupling member 1. A plurality of engagement protrusions 21*c* are formed at an equal pitch in the longitudinal direction. The engagement protrusions 21*c* are formed on a surface 211*c* that is slightly higher than the surface of the plate-like section due to a step. The step is formed during production, and need not necessarily be provided. The engagement holes 12*e* and 12*f* (that make a pair) formed in the back sides of the coupling member 1*c* have a rectangular shape that corresponds to the short quadrangular prism shape of the engagement protrusions. In the fifth embodiment, three engagement holes (12*e*, 12*f*) are formed in each support member in the vertical direction. The center engagement hole is a through-hole, and the upper and lower engagement holes 121*e* and 121*f* are non-through-holes. The upper and lower engagement holes 121*e* and 121*f* are formed in the shape of a groove (i.e., do not have an upper wall or a lower wall). When an upward force is applied to the coupling member 1*c*, a lower wall 122 of the upper engagement hole comes in contact with the engagement protrusion 21*c* of the coupling member 1*c* post 2. When a downward force is applied to the coupling member 1*c*, an upper wall 123 of the lower engagement hole comes in contact with the engagement protrusion 21*c* of the coupling member 1*c*. The back side of each of the support members 11*a* and 11*b* (that make a pair) is provided with an allowance (depression) 125 that corresponds to the surface 211*c* that is slightly higher than the surface of the plate-like section due to a step. The outer side of the support members 11*a* and 11*b* (that make a pair) form a tapered surface that gradually slopes outward in the downward direction. Note that the engagement section 4 of the shelf board member 3 has a shape that corresponds to the shape of the coupling member 1*c* (see FIG. 6). The coupling member 1*c* is attached to the desired position of the post 2 illustrated in FIGS. 40 to 42 in the same manner as described above with reference to FIGS. 7 to 9. The assembly shelf that includes the coupling member 1*c* can achieve the same advantageous effects as those achieved by the assembly shelf 10.

An example of the engagement section of the shelf board member is described below with reference to FIGS. 34 and 35. The engagement section 4 of the shelf board member 3 includes a hack plate attachment section 42 in which a screw hole 44 is formed under the back side of the engagement main body 411 having a tapered surface, and a shelf board member attachment section 41 that is situated on the outer side of the back plate attachment section 42, a screw hole 43 that is continuous with the back plate attachment section 42 being formed in the shelf board member attachment section 41. A back plate 45 is secured on the back plate attachment section 42 using a screw 46. This makes if possible to prevent upward displacement of the shelf board member 3. The shelf board member attachment section 41 is secured on the shelf board member 3 using a screw 47. This makes it possible to prevent situation in which the engagement section 4 is removed from the shelf board member 3.

Note that various modifications may be made of the above embodiments. The protrusion of the coupling member is not limited to a protrusion having a short cylindrical shape. The protrusion of the coupling member may be a protrusion having an elliptical cross-section shape, a protrusion having a diamond cross-section shape, or a protrusion having ah irregular cross-section shape. The support members 11*a* and 11*b* (that make a pair) are not limited to the above configuration. The second plate-like section 112*a* having a small thickness may be omitted. In this case, the same advantageous effects as those achieved by the coupling member 1 can also be achieved although three tapered surfaces engage the engagement section 4 of the shelf board member 3. The number of the posts 2 is not limited to four. It suffices that the assembly shelf include at least one post. In this case, the coupling member 1 may be used corresponding to the number of the posts 2. When supporting one shelf board member, the post and the coupling member 1 according to the invention may be used for at least one position, and a known support structure may be used for other positions.

INDUSTRIAL APPLICABILITY

Since the assembly shelves according to the embodiments of the invention are designed so that the shelf board member is not provided with a protrusion, the assembly shelves according to the embodiments of the invention are safe for the worker during assembly. Moreover, it is unnecessary to use an assembly tool. When a plurality of shelf board members have been fitted to the posts, and a middle shelf board member among the plurality of shelf board members and a shelf board member among the plurality of shelf board members that is situated immediately above the middle shelf board member are situated so that the middle shelf board member can be tilted, only the middle shelf board member can be removed or repositioned without removing the other shelf board members.

REFERENCE SIGNS LIST

1: Coupling member
2: Post
3: Shelf board member
4: Engagement section of shelf board member
10 to 10*g*: Assembly shelf
11*a*, 11*b*: Support members that make a pair
12: Engagement hole
21: Engagement protrusion

The invention claimed is:

1. A coupling member comprising:

a pair of support members comprising a first support member and a second support member located apart from and opposite to the first support member in a widthwise direction of said coupling member, each of the first and second support members comprises a first end portion and an opposing second end portion, the first support member linked to the second support member at the first end portions, an opening defined by the pair of support members and located at the second end portions; and at least one pair of engagement holes comprising a first engagement hole formed in the first support member and a second engagement hole located opposite the first engagement hole and formed in the second support member, wherein each of the pair of support members has a tapered outer surface that gradually slopes outward in a downward direction, and wherein in a widthwise direction of the coupling member, a width from which the first support member and the second support member are located apart from each other is approximately the same from the first end portions to the second end portions, and a width of the opening is approximately the same as the width from which the first support member and the second support member are located apart from each other.

2. The coupling member according to claim 1, wherein each of the pair of engagement holes is a through-hole or a non-through-hole.

3. The coupling member according to claim 1, the coupling member being formed of a metal, a resin, glass, carbon, or a composite thereof.

4. The coupling member according to claim 3, wherein the pair of support members are linked by a link member, wherein in a thickness direction of the coupling member a width of the entire link member is less than a width of each of the pair of support members.

5. A coupling member comprising:

a pair of support members comprising a first support member and a second support member located apart from and opposite to the first support member in a widthwise direction of said coupling member, each of the first and second support members comprises a first end portion and an opposing second end portion, the first support member linked to the second support member at the first end portions, an opening defined by the pair of support members and located at the second end portions; and at least one pair of engagement holes comprising a first engagement hole formed in the first support member and a second engagement hole located opposite the first engagement hole and formed in the second support member, wherein each of the pair of support members has a tapered outer surface that gradually slopes outward in a downward direction, and wherein each of the pair of support members includes a first plate-like section that is situated on a side where the pair of support members are linked, and has an approximately plate-like shape, and a second plate-like section that is situated on a side where the pair of support members are not linked, and has an approximately plate-like shape, the second plate-like section being continuous with the first plate-like section so that a step is formed therebetween, and having a thickness smaller than that of the first plate-like section.

6. The coupling member according to claim 1, wherein two or more pairs of the engagement holes are formed in a vertical direction.

7. The coupling member according to claim 1, wherein each of the pair of support members has three or four continuous outer sides.

8. An assembly shelf comprising:

the coupling member according to claim 1;

a post comprising a plate-like section, a plurality of engagement protrusions formed on the plate-like section in a longitudinal direction at regular or irregular intervals; and a shelf board member comprising an engagement section that engages with the coupling member, wherein the coupling member is attached to the post so as to hold each side of the plate-like section in a state in which the engagement protrusion of the post engages with one of the engagement holes of the coupling member.

9. The assembly shelf according to claim 8, wherein the post has an L-shaped cross-sectional shape, a T-shaped cross-sectional shape, a cruciform cross-sectional shape, or a channel shape.

10. An assembly shelf comprising:

a coupling member comprising:

a pair of support members comprising a first support member and a second support member located apart from and opposite to the first support member in a widthwise direction of said coupling member, each of the first and second support members comprises a first end portion and an opposing second end portion, the first support member linked to the second support member at the first end portions, an opening defined by the pair of support members and located at the second end portions; and at least one pair of engagement holes comprising a first engagement hole formed in the first support member and a second engagement hole located opposite the first engagement hole and formed in the second support member, a post comprising a plate-like section, a plurality of engagement protrusions formed on the plate-like section in a longitudinal direction at regular or irregular intervals; and a shelf board member comprising an engagement section that engages with the coupling member, wherein each of the pair of support members has a tapered outer surface that gradually slopes outward in a downward direction, wherein the coupling member is attached to the post so as to hold each side of the plate-like section in a state in which the engagement protrusion of the post engages with one of the engagement holes of the coupling member, and wherein the post has a T-shaped cross-sectional shape, and has a structure in which two plate-like sections that form a letter T and are situated opposite to each other are provided with a plurality of engagement protrusions that are formed in the longitudinal direction at regular or irregular intervals.

11. The assembly shelf according to claim 8, wherein the engagement protrusions have a height of 0.5 to 3 mm.

* * * * *